US007919735B2

(12) United States Patent
Kiyono et al.

(10) Patent No.: US 7,919,735 B2
(45) Date of Patent: Apr. 5, 2011

(54) HIGH-FREQUENCY HEATING DEVICE

(75) Inventors: Yasuhiro Kiyono, Kyoto (JP); Toshihiro Naruo, Kyoto (JP); Kouji Yamamoto, Souraku-gun (JP); Yuji Hayakawa, Shiki-gun (JP); Isao Mizuta, Tenri (JP)

(73) Assignees: Panasonic Corporation, Osaka (JP); Omron Corporation, Kyoto (JP)

( * ) Notice: Subject to any disclaimer, the term of this patent is extended or adjusted under 35 U.S.C. 154(b) by 1210 days.

(21) Appl. No.: 10/556,928

(22) PCT Filed: May 14, 2004

(86) PCT No.: PCT/JP2004/006855
§ 371 (c)(1),
(2), (4) Date: Oct. 12, 2006

(87) PCT Pub. No.: WO2004/102075
PCT Pub. Date: Nov. 25, 2004

(65) Prior Publication Data

US 2007/0029175 A1 Feb. 8, 2007

(30) Foreign Application Priority Data

May 15, 2003 (JP) ..... 2003-136683

(51) Int. Cl.
*H05B 6/68* (2006.01)
*H05B 6/64* (2006.01)

(52) U.S. Cl. ..... 219/690; 219/722; 219/739

(58) Field of Classification Search ..... 219/690, 219/722, 739, 715, 702, 723, 724, 716; 126/197; 200/50.12, 50.13
See application file for complete search history.

(56) References Cited

U.S. PATENT DOCUMENTS 6,634,476 B2 10/2003 Inoue et al.
6,664,523 B1 * 12/2003 Kim et al. ..... 219/722
6,811,009 B2 11/2004 Inoue et al.

FOREIGN PATENT DOCUMENTS

JP 59-200133 A 11/1984
JP 61-151916 A 7/1986
JP 2-95153 U 7/1990
JP 11-325474 11/1990

(Continued)

OTHER PUBLICATIONS

Japanese Office action dated Aug. 4, 2009.

*Primary Examiner* — Quang T Van
(74) *Attorney, Agent, or Firm* — Pearne & Gordon LLP

(57) ABSTRACT

In fabricating a door switch for a microwave oven, two switches are incorporated in a single switch case to allow a reduction in the size and to allow common use of switch components, thereby achieving a cost reduction through a reduction in the number of components. Further, a contact switching structure tilted in conjunction with opening and closing of a door is provided to achieve high accuracy in switching the switches. There is provided a first switch whose contact portions are switched by elastically displacing a conductive contact piece in the switch case when a first tilting lever is tilted, a second switch whose contact portions are switched by elastically displacing another conductive contact piece in the switch case at timing that is slightly different from the timing for switching the contact portions of the first switch, and a third switch which is switched when a second tilting lever is tilted.

7 Claims, 25 Drawing Sheets

FOREIGN PATENT DOCUMENTS

| | | | |
|---|---|---|---|
| JP | 3-175215 | | 7/1991 |
| JP | 04-019925 | A | 1/1992 |
| JP | 5-17403 | U | 3/1993 |
| JP | 05-335075 | A | 12/1993 |
| JP | 11-214147 | | 8/1999 |
| JP | 2001-050543 | A | 2/2001 |
| JP | 2001-241672 | | 9/2001 |
| JP | 2002-195303 | A | 7/2002 |
| JP | 2002-245892 | A | 8/2002 |
| JP | 2002-357324 | | 12/2002 |
| JP | 2003-68165 | | 3/2003 |
| JP | 2003-109470 | A | 4/2003 |

* cited by examiner

HIGH-FREQUENCY HEATING DEVICE

TECHNICAL FIELD

The present invention relates to a high frequency heating apparatus in which a plurality of switches is efficiently incorporated to reduce the size of the apparatus and to improve the switching performance of the switches, the switches being switched in conjunction with opening and closing of a door of the high frequency heating apparatus.

BACKGROUND ART

A door switch mechanism of a microwave oven, which is a high frequency heating apparatus, will now be described by way of example. Three types of switches, i.e., a latch switch, a door switch, and a monitor switch are incorporated in the door switch mechanism of the microwave oven in consideration to safety in using the microwave oven, and those switches are switched with on and off signals which are obtained with time differences in conjunction with opening and closing of a door.

For example, a door key mounted on an inner surface of the door that exposes and closes an opening on a front side of the microwave oven is provided opposite to switches such as a micro-switch mounted on the main body of the microwave oven, and a switching operation is performed with the door key directly associated with the switches on the main body when the door is closed.

In this case, however, the operation of each switch may be mistimed as a result of a variation of the mounting position of the switch, and an excessively great force may be applied to the switches by an impact that occurs when the door is closed forcefully. For this reason, there has been a possibility of inducing factors causing variation of switching characteristics to disable normal operations of the switches.

A door switch mechanism is also known (JP-A-11-214147), in which two operation pins mounted on an inner surface of a door of a microwave oven are disposed opposite to two respective levers provided on the main body in a face-to-face relationship and in which micro-switches in internal positions are switched through the operation pins and levers in accordance with opening and closing of the door.

In this case, however, since long levers are required, the door switch mechanism as a whole has been large-sized, and a cost increase has resulted because of a great number of components involved. Further, the use micro-switches has involved complicated wiring operations because terminals of three micro-switches are oriented in different respective directions depending on the mounting directions thereof.

Under the circumstance, the invention makes it possible to achieve compactness by incorporating two switches in a single switch case and to achieve a cost reduction through a reduction in the number of components that is achieved by common use of switch components. Further, it is an object of the invention to provide a door switch for a microwave oven having a contact switching structure that is tilted in conjunction with opening and closing of a door to achieve highly accurate performance in switching a switch.

DISCLOSURE OF THE INVENTION

The invention provides a door switch for a microwave oven in which a plurality of switches are switched with time differences by movements of a plurality of tilting levers that are tilted in accordance with opening and closing operations of a door that exposes and closes an opening on a front side of the microwave oven, the includes a first switch whose contact portions are switched by elastically displacing a conductive contact piece in a switch case through a first cam formed at an inner end of a first tilting lever when said lever is tilted, a second switch whose contact portions are switched by elastically displacing another conductive contact piece in said switch case through a second cam formed at the inner end of said first tilting lever at timing different from the timing for switching the contact portions of said first switch, and a third switch switched through a third cam formed at the inner end of a second tilting lever when said lever is tilted.

According to the invention, since the two switches can be incorporated in the single switch case and a switching operation for turning the two switches on and off can be performed in conjunction with, in particular, a movement of the first tilting lever, the first tilting lever can be effectively used as a component common to the two switches to fabricate the device compact. In particular, since the first cam and the second cam formed at the inner end of the first tilting lever can be also used as switching operation members, the first tilting lever has the functions of a lever and a cam although it is a single component, which allows the number of components of the switch to be reduced. Further, the size and cost of the switch can be reduced as a result of the reduction in the number of components.

When the switching between the plurality of contact portions is performed with time differences in association with the position to which the first tilting lever is tilted, the timing of switching can be set as desired. Therefore, the contact portions of each switch can be switched at highly accurate timing in accordance with the tilting operation.

Conductive pieces in the form of plate springs may be used as said conductive contact pieces, and said conductive contact pieces themselves can be provided with an elastic returning force by forming the conductive contact pieces in any curved or bent shape that is suitable for putting them in contact with each other and moving them away from each other. The contact portions can be reliably made to contact and move away from each other by elastically displacing each of the conductive contact pieces in the direction of expanding the gap between the contact portions thereof and in the direction of narrowing the same in conjunction with the tilting force of the first tilting lever. A contact switching structure which is reliable and stable in that it has a capability of eliminating seizure between the contact portions can be obtained by employing a configuration in which the conductive contact portions are in slidable contact with each other.

As another mode of the invention, a door switch for a microwave oven may be provided, in which a switch base is mounted inside a main body frame associated with a door that exposes and closes an opening on a front side of a microwave oven; a first tilting lever and a second tilting lever tilting at different timing in accordance with opening and closing operations of said door are mounted on the switch base; and three switches mounted on said switch base are switched with time differences by movements of said two tilting levers. The door switch having a configuration in which a first pivot portion tiltably pivoted on a switch case and a first cam and a second cam for switching operations are provided at an inner end of said first tilting lever; a first lever pressure-receiving portion associated with a door key mounted on said door is provided at an outer end of said lever; and the switch case incorporates a first switch which includes a plurality of conductive contact pieces side by side so as to face said first cam and whose contact portions are switched when a first conductive contact piece contacts a second conductive contact piece by being urged and elastically displaced by said first cam as said first tilting lever is tilted and a second switch which includes a plurality of conductive contact pieces provided side by side so as to face said second cam and whose contact portions are switched when said second cam urges a fourth conductive contact piece which has been in contact with a third conductive contact piece to move it away from the same and to thereafter put said fourth conductive contact piece in contact with a fifth conductive contact piece at timing different from the timing for switching the contact portions of said first switch, and in which a second pivot portion tiltably pivoted on the switch base and a third cam associated with a push button of a third switch mounted on said switch base to push the same are provided at an inner end of said second tilting lever; and a second lever pressure-receiving portion associated with said door key is provided at an outer end of said second tilting lever.

In this case again, since the two switches are incorporated in the single switch case, the switch case and the first tilting lever can be used as components common to the two switches. Further, the operation timing of the switching operation for turning the first switch on and off and the switching operation for turning the second switch on and off can be accurately associated with each position of the first tilting lever when the lever is tilted. For example, a setting may be made such that the contact portions of the first switch are first switched when the first tilting lever is tilted and such that the contact portions of the second switch are thereafter switched at a slight time lag.

Referring to the direction in which the conductive contact pieces are disposed, since the contact pieces are disposed radially about the first pivot portion of the first tilting lever, the first can and the second cam of the first tilting lever tilting about the first pivot portion can be efficiently associated with the conductive contact pieces.

As another mode of the invention, a configuration may be employed, in which an outer end of each of the conductive contact pieces of said first switch and second switch are aligned with an outer end of a terminal protruding from an outer surface of said third switch so as to protrude in the same direction.

In this case, since the outer ends of the conductive contact pieces of and terminals of all switches can be protruded in the same direction, wiring operations can be facilitated to reduce the man-hour for wiring. In particular, when the outer ends of the terminals are all protruded to the same height in the same direction, wiring operations are further facilitated.

As another mode of the invention, a configuration may be employed, in which the distances from the pivot portions where said first tilting lever and second tilting lever are pivoted to the outer ends of the levers are longer than the distances from the pivot portions to the inner ends to set the leverage of the lever outer end of each of said tilting levers that is tilted about the pivot portion greater than the leverage of the inner end of the lever.

In this case, since a great leverage is set for the outer ends of the levers, a tilting force from the outer ends of the levers tilting about the pivot portions may be small according to the principles of the lever, and the tilting force can be efficiently transferred to the inner ends of the levers. Therefore, the first tilting lever and the second tilting lever have a small load resistance when tilted and can move smoothly.

As another mode of the invention, a configuration may be employed, in which a switch unit is formed by integrally incorporating said first tilting lever in said switch case.

The switch unit can be treated as a single unit although it comprises two components, i.e., the switch case and the first tilting lever, and the unit can therefore be easily assembled on the switch base. Since the two components can be assembled in advance as a single unit, they can be easily handled and managed.

As another mode of the invention, said switch case may be formed by combining a case main body and a case cover, and a recess having the same shape as that of said case main body may be formed on a switch case mounting surface of said switch base.

In this case, since the recess having the same shape as that of the case main body is formed in advance on the switch base as a switch housing portion in which the two switches are to be incorporated, the components constituting the switches can be directly incorporated in the recess, and a part of the switch base can therefore be used instead of the case main body. It is therefore possible to omit the case main body and to thereby reduce the number of components.

As another mode of the invention, said switch case may be formed by combining a case main body and a case cover, and a cover portion having the same shape as that of said case cover may be formed on a switch case mounting surface of said switch base.

In this case, since the cover portion having the same shape as that of the case cover is formed in advance on the switch base, the switch case can be formed only by mounting the case main body on the same. In this case again, since a part of the switch base can therefore be used instead of the case cover. It is therefore possible to omit the case cover and to thereby reduce the number of components.

Another configuration according to the invention is characterized in that there is provided a heating chamber for containing and heating foods, a high frequency generating device for supplying a high frequency to said heating chamber, an openable and closable door facing an open side of said heating chamber and having an operation pin, and a plurality of switches each of which is switched to establish conduction to a power supply circuit for heating at said heating chamber, and in that there is provided a signal switch operated through a first lever mounted on a switch mounting plate located on a side of said heating chamber in conjunction with the operation of said operation pin and a main switch operated through a second lever in conjunction with opening and closing operations of said door, said signal switch incorporating a short switch operated through said first lever.

According to the invention, since the signal switch incorporates the short switch, there is no need for providing a micro-switch to be used as a signal switch and a micro-switch to be used as a short switch independently. It is therefore possible to employ a simple structure and to achieve an advantage from the viewpoint of space in that space saving can be achieved.

Another configuration according to the invention is characterized in that there is provided a heating chamber for containing and heating foods, a high frequency generating device for supplying a high frequency to said heating chamber, an openable and closable door facing an open side of said heating chamber and having a first operation pin and a second operation pin, and a plurality of switches each of which is switched to establish conduction to a power supply circuit for heating at said heating chamber, and in that there is provided a signal switch operated through a first lever mounted on a switch mounting plate located on a side of said heating chamber in conjunction with the operation of said first operation pin and a main switch operated through a pin guide mounted on a front panel of said heating chamber and a second lever mounted on said switch mounting plate in conjunction with the operation of said second operation pin, said signal switch incorporating a short switch operated through said first lever.

According to the invention, the signal switch operates in conjunction with the operation of the first operation pin, and the switch is operated by the first lever mounted on the switch mounting plate located on a side of the heating chamber. The main switch operates in conjunction with the operation of the second operation pin, and the switch is operated by the pin guide mounted on the front panel of the heating chamber and the second lever mounted on the switch mounting plate. The signal switch incorporates the short switch which is operated through the first lever. Therefore, the signal switch and the short switch can be easily set to operate with time differences using the first lever.

Another configuration according to the invention is characterized in that said signal switch operated through said first lever and a switch unit incorporating said short switch are configured such that a contact of said signal switch is off and a contact of said short switch is in an on-state when the door of said heating chamber is open and such that, when the door of said heating chamber is closed, a first operating portion of said first lever urges a movable contact portion of said signal switch to turn on the same after a second operating portion of said first lever urges a movable contact portion of said short switch to turn said short switch from off to on.

According to the invention, when the door of the heating chamber is closed, the first operating portion of the first lever urges the movable contact portion of the signal switch to turn on the same after the second operating portion of the first lever urges a movable contact portion of the short switch to turn the short switch from off to on. It is therefore possible to allow the heating chamber to operate only after making sure that the door is in the closed state by setting a predetermined time as the interval that passes after the short switch is turned off until the signal switch is turned on.

Another configuration according to the invention is characterized in that said switch unit comprises said switch mounting plate and a switch cover covering the contact portion of said signal switch and the contact portion of said short switch and in that it has a configuration in which said main switch is mounted on said switch mounting plate; a rotary shaft of said first lever is provided on said switch mounting plate; and said first lever is inserted in said rotary shaft to hold it with said switch cover.

In this case, when the switch cover is attached to the switch mounting plate, the switch unit is covered, and the first lever is inserted in the rotary shaft. The support for the first lever is thus provided simply by an operation of mounting the same to the switch mounting plate, which simplifies a structure for automatic mounting.

Another configuration according to the invention is characterized in that a flange is extended forward of said rotary shaft of said first lever to prevent a liquid which has flowed along said first lever from entering.

In this case, the flange extended forward of the rotary shaft discharges any liquid such as meat juice or water which has flowed along the first lever to the outside to prevent it from entering the switch unit, which makes it possible to prevent any liquid from entering the switch unit and to thereby avoid erroneous operations attributable to corrosion of the contacts and the like.

Another configuration according to the invention is characterized in that the contact portions in said switch unit are provided behind said rotary shaft of said first lever to keep them less vulnerable to the invasion of a liquid which has flowed along said first lever.

In this case, since the contact portions in the switch unit are disposed behind the rotary shaft, any liquid such as meat juice or water which as flowed along the first lever will not enter the switch unit. It is therefore possible to avoid erroneous operations attributable to corrosion of the contacts and the like.

Another configuration according to the invention is characterized in that the contact portion of the short switch is provided lower to keep it less vulnerable to the invasion of a liquid which has flowed along the first lever.

In this case, the contact portion of the short switch is disposed lower, it is apart from the path of a liquid such as meat juice or water which has flowed along the first lever, and they can be kept less vulnerable to the invasion of a liquid.

Another configuration according to the invention is characterized in that there is provided an indicator indicating the operating position of said switch unit incorporating said signal switch and said short switch by a difference between the colors of the exteriors of said first lever and said switch unit.

In this case, the on and off states of a contact can be checked from the difference between the colors of the exteriors of the first lever and the switch unit differently.

Another configuration according to the invention is characterized in that there is provided an indicator indicating the operating position of said switch unit incorporating said signal switch and said short switch by marks provided on the exteriors of said first lever and said switch unit.

In this case, the on and off states of a contact can be checked from the marks provided on the exteriors of the first lever and the switch unit.

Another configuration according to the invention is characterized in that a protrusion is provided on the top side or bottom side of the exterior of said switch unit to prevent miss-wiring of a connection of said switch unit incorporating said signal switch and said short switch.

In this case, the protrusion provided on the top side or bottom side of the switch unit prevents miss-mounting of a connector connected to the signal switch and the short switch in the switch unit, and the connector can be reliably mounted.

Another configuration according to the invention is characterized in that a contact among contacts formed in said short switch which forms a short circuit between said short switch and said main switch is formed in a substantially R-like shape on one side thereof.

In this case, when contacts constituting the short circuit are shorted, since one of the contact is formed in a substantially R-like shape, an arc current generated between the contacts flows uniformly, which prevents the contact from scattering and allows the short circuit to be formed reliably.

Another configuration according to the invention is characterized in that a contact operating portion of said switch mounting plate is formed in a substantially comb-like shape to prevent dust from entering a gap between said switch mounting plate and said switch cover that is formed when said first lever is moved.

In this case, since the contact operating portion of the switch mounting plate is formed in a substantially comb-like shape, the switch mounting plate and the switch cover are in the form a maze. It is therefore possible to prevent dust from entering a gap between the switch mounting plate and the switch cover.

Another configuration according to the invention is characterized in that a grease reservoir is formed at a contact operating portion of said switch mounting plate and said first lever to prevent dust from entering a gap between said switch mounting plate and said switch cover that is formed when the first lever is moved.

In this case, the grease reservoir formed at the contact operating portion of the first lever prevents dust from entering a gap between the switch mounting plate and the switch cover which is formed when the lever is moved.

Another configuration according to the invention is characterized in that said switch cover is transparent.

In this case, the states of the internal contacts can be directly checked through the transparent switch cover.

Another configuration according to the invention is characterized in that the contacts of said signal switch and said short switch incorporated in said switch unit are offset from each other and wiped after they contact.

In this case, the contact portions of the signal switch and the contact portions of the short switch are offset from each other and wiped when they contact. Each contact portion is thus always cleaned to prevent arcing, whereby seizure of the contact due to an electric current can be prevented.

Another configuration according to the invention is characterized in that said first lever is returned by an elastic force of a contact piece of said short switch incorporated in said switch unit.

In this case, since the first lever is returned using an elastic repulsion of the contact piece of the short switch, there is no need for incorporating a returning member such as a return spring in the first lever, and a reduction in the number of components can be achieved.

Another configuration according to the invention is characterized in that said main switch is disposed opposite to said second lever and on the side of the second operation pin or a second operation key for operating said second lever with reference to a rotary shaft of said second lever.

In this case, since the main switch is disposed tangentially to the second lever, an operation of returning the second lever can be directly performed using a switch returning mechanism incorporated in the main switch. As a result, it is possible to omit a return spring or the like which is otherwise incorporated in the second lever, and the number of components can be thus reduced.

Another configuration according to the invention is characterized in that a protrusion is provided on said second lever to urge said first lever when said second lever is urged for turning said main switch on after said short switch is turned off.

In this case, as the second lever rotates, the first lever is rotated by the protrusion to turn the short switch off and to turn the main switch on thereafter. Thus, even if the second lever is pushed forcibly (pushed intentionally) when the door is open, it is possible to prevent a fuse in the short circuit from being blown.

Figure 1:
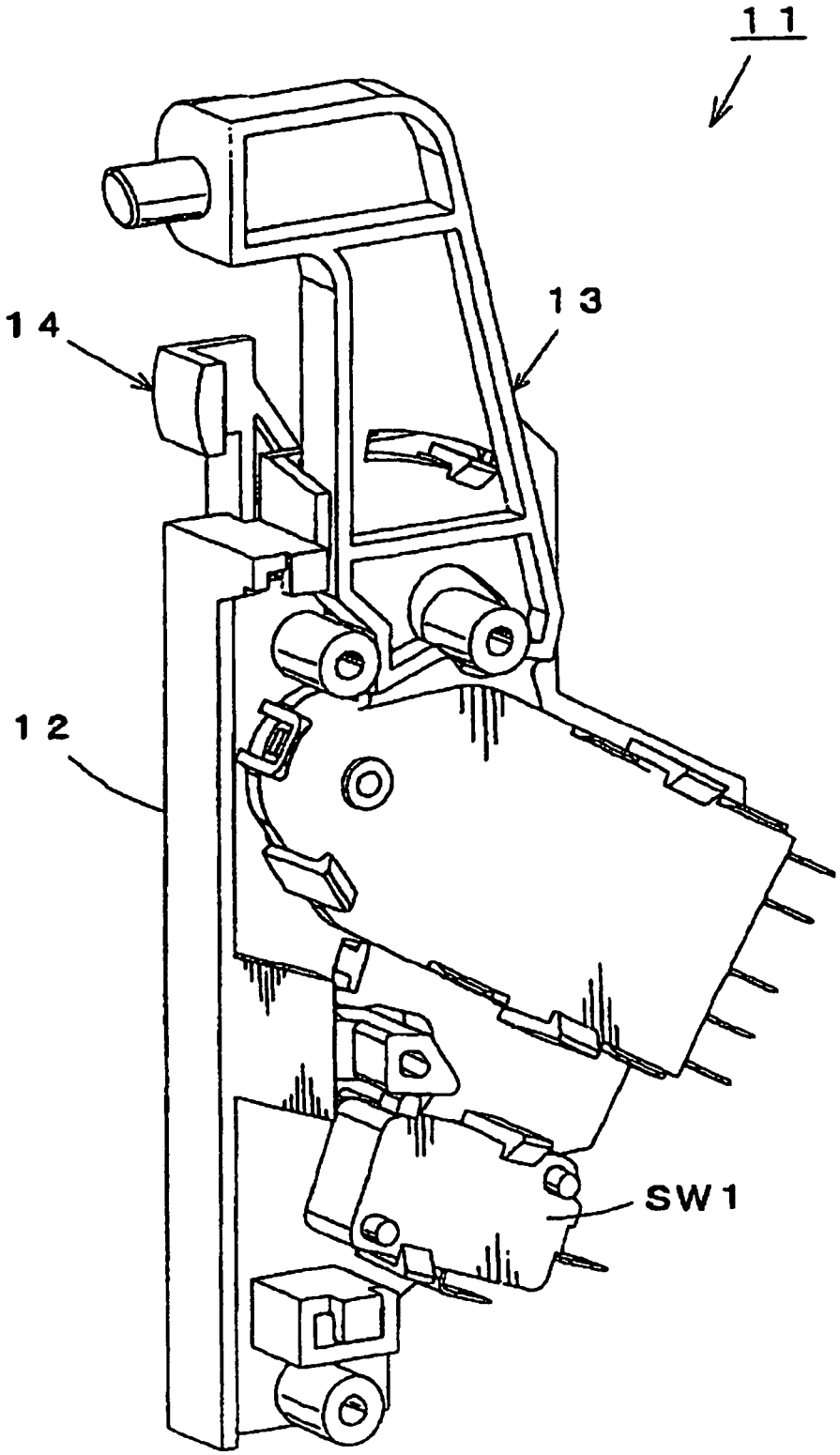
FIG. 1 is an external perspective view showing a wall of a microwave oven door switch used in a high frequency heating apparatus of a first embodiment of the invention.

In the drawings, reference numerals 11, 141, 151, and 200 represent a microwave oven door switch; 13 and 144 represent a switch unit; 15 represents a switch case; 16, 146, and 155 represent a first tilting lever; 24 represents a second tilting lever; 143 represents a switch housing portion; 153 represents a cover portion; 201 represents a switch mounting plate; 202 represents a switch unit; 203 represents a first lever; 204 represents a second lever; 205 represents a main switch (switch); 207 and 208 represent a rotary shaft; 216 represents a switch cover; 237 represents a flange; 238 represents a grease reservoir; 240 represents a protrusion; 250 represents a signal switch (switch); 253 represents a short switch (switch); C1 and C2 represent a cam; SW1 represents a latch switch; SW2 represents a monitor switch; and SW3 represents a door switch.

BEST MODE FOR CARRYING OUT THE INVENTION

A plurality of preferred embodiments of a high frequency heating apparatus according to the invention will now be described based on the drawings.

First Embodiment

Figure 2:
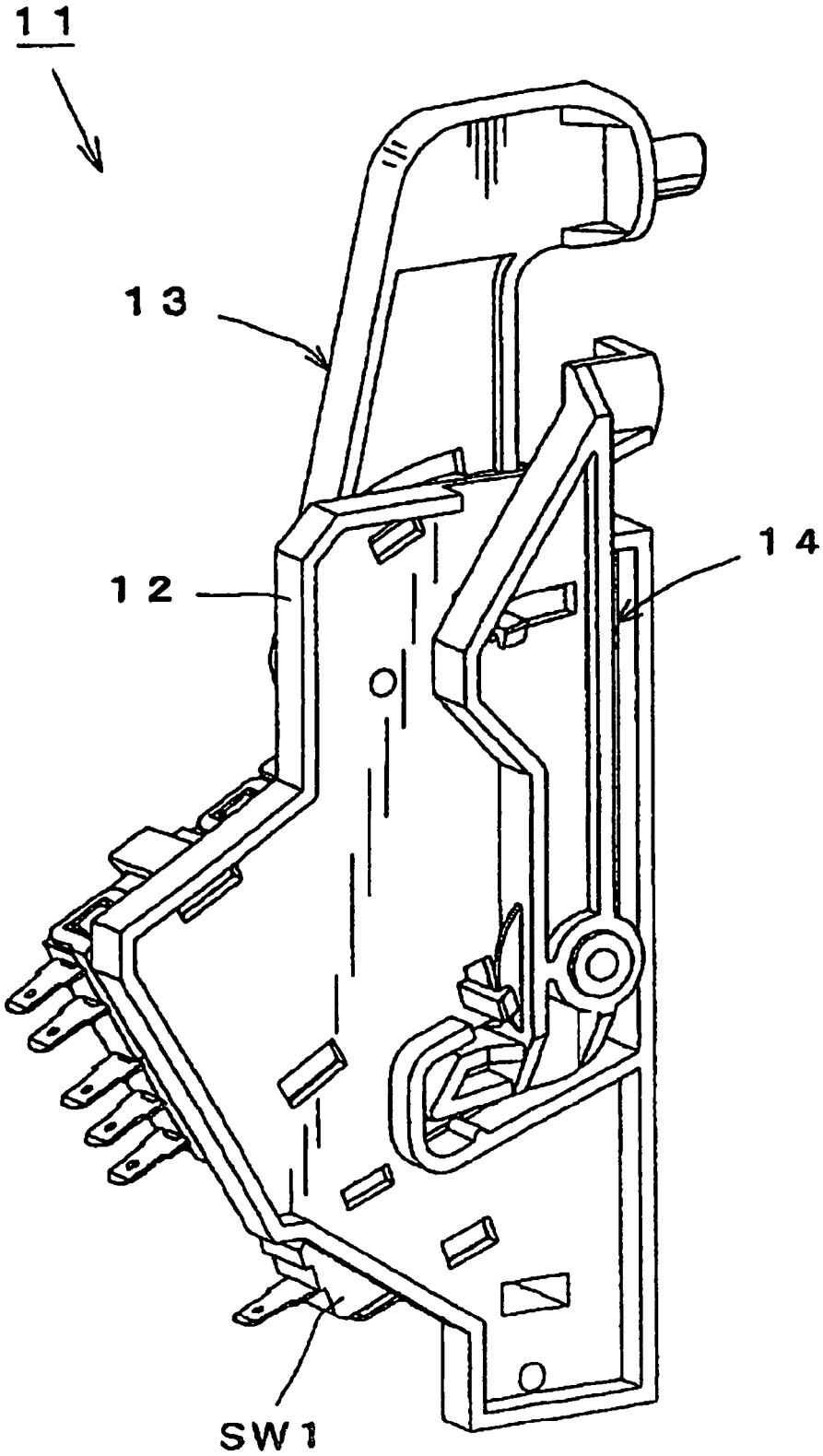
FIG. 2 is an external perspective view showing another wall of the microwave oven door switch.

As shown in FIGS. 1 and 2, a microwave oven door switch 11 used for a high frequency heating apparatus that is a first embodiment of the invention is formed by mounting a switch unit 13 and a micro-switch (hereinafter referred to as a latch switch) SW1 on a wall of a switch base 12 provided by erecting a longitudinal substrate and mounting a latch switch mechanism 14 on another wall.

Figure 3:
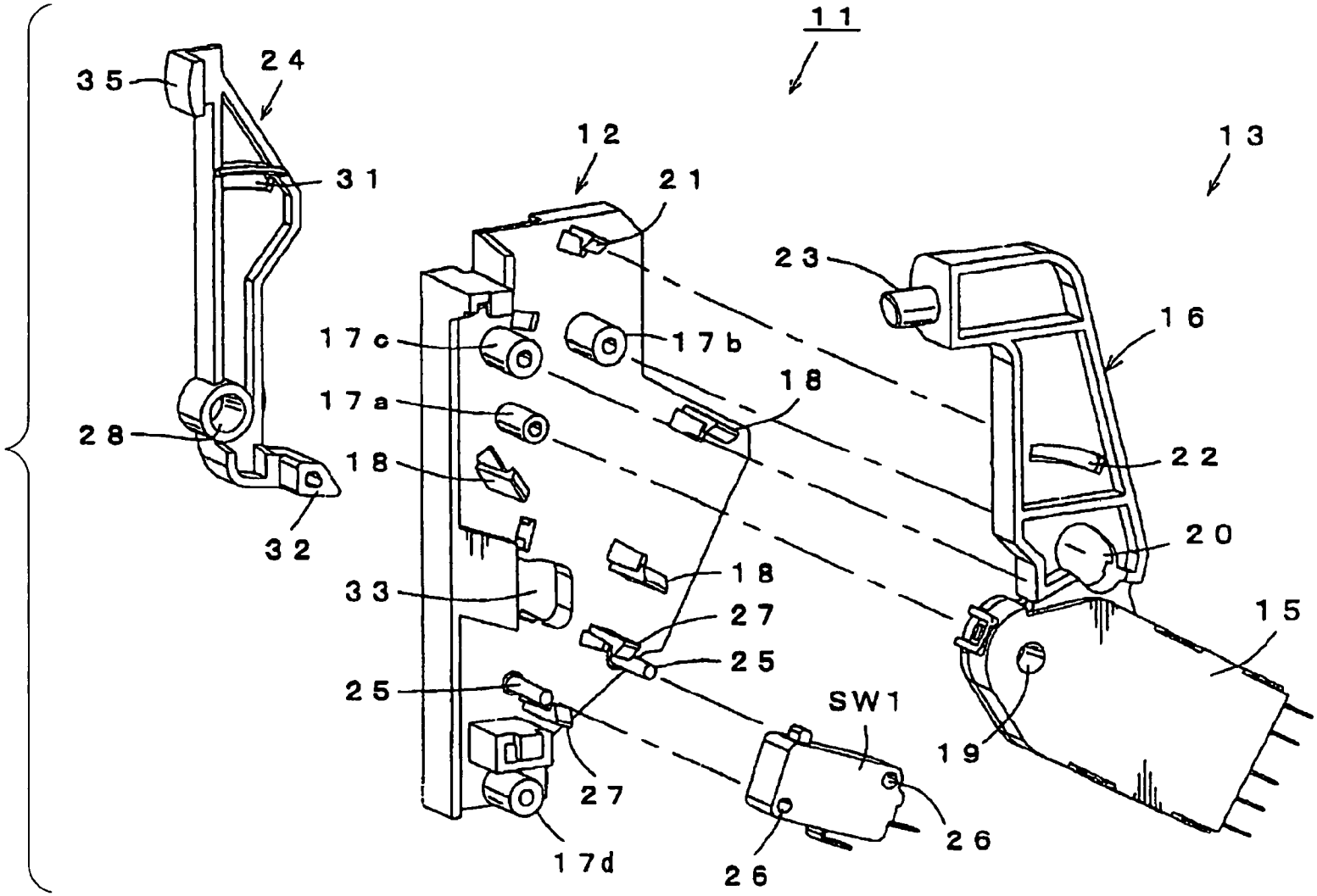
FIG. 3 is an exploded perspective view of the microwave oven door switch taken from the side of the first wall.

Referring to the above-mentioned switch unit 13, as shown in FIG. 3, a lower end of an inverted-L-shaped first tilting lever 16 is incorporated a switch case 15 to integrate them, and two switches, i.e., a monitor switch SW2 to serve as a third switch and a door switch SW3 to serve as a first switch as will be described later are incorporated side by side in the switch case 15. The switch case 15 is mounted to an upper part of a wall of the switch base 12 such that the first tilting lever 16 which is provided for operating the two switches protrudes from the switch case 15.

First to third cylindrical shafts 17*a* to 16*c* protrude from the upper part of the wall of the switch base 12, and a fourth cylindrical shaft 17*d* protrudes from a lower part of the wall of the switch base 12. The periphery of the switch unit 13 is anchored to prevent the unit from coming off using several anchoring nails 18 protruding from the upper part of the wall of the switch base 12 with the first cylindrical shaft 17*a* inserted through the switch unit 13, whereby the switch unit 13 is mounted to the switch base 12 integrally therewith.

The above-mentioned first cylindrical shaft 17*a* is inserted through an insertion hole 19 provided so as to extend through the switch case 15 in the mounting direction of the same, whereby the switch case 15 is positioned, secured, and mounted on the switch base 12.

The second cylindrical shaft 17*b* is inserted through a slot 20 formed in the first tilting lever 16 to keep the first tilting lever free of interference in moving, the third cylindrical shaft 17*c* is protruded in a position out of the range over which the first tilting lever 16 is tilted for the same reason. Further, holes in the second to fourth cylindrical shafts 17*b* to 17*d* are used for mounting the switch base 12 to a housing of a microwave oven which is not shown.

Further, a tilt-permitting nail 21 is protruded from the upper part of the wall of the switch base 12, and an arcuate guide groove 22 formed in the first tilting lever 16 in a position in the middle of the height of the same so as to extend in the tilting direction thereof is engaged with the tilt-permitting nail 21 to guide the tilt of the lever.

The above-described first tilting lever 16 is tiltably pivoted by incorporating a lower end thereof in the switch case 15 which will be described later and is tilted about the internal pivot portion serving as a fulcrum of tilting under an external force from a door key when the door, which will be described later, is closed by a pressure-receiving protrusion 23 protruding as a first pressure-receiving portion from an upper end of the lever. When the lever 16 is tilted about the pivot portion serving as a fulcrum of tilting, a first cam and a second cam to be described later formed at the lower end of the lever operate to switch the switches SW2 and SW3, respectively, to be described later.

The latch switch mechanism 14 is formed by combining the latch switch SW1 that is the second switch and a second tilting lever 24. The latch switch SW1 is pivoted by inserting a pair of mounting shafts 25 protruding from another wall of the switch base 12 through a pair of through holes 26 horizontally extending through the latch switch SW1, and the latch switch SW1 is integrally engaged with and secured to the switch base 12 with a pair of upper and lower engaging nails 27.

Figure 4:
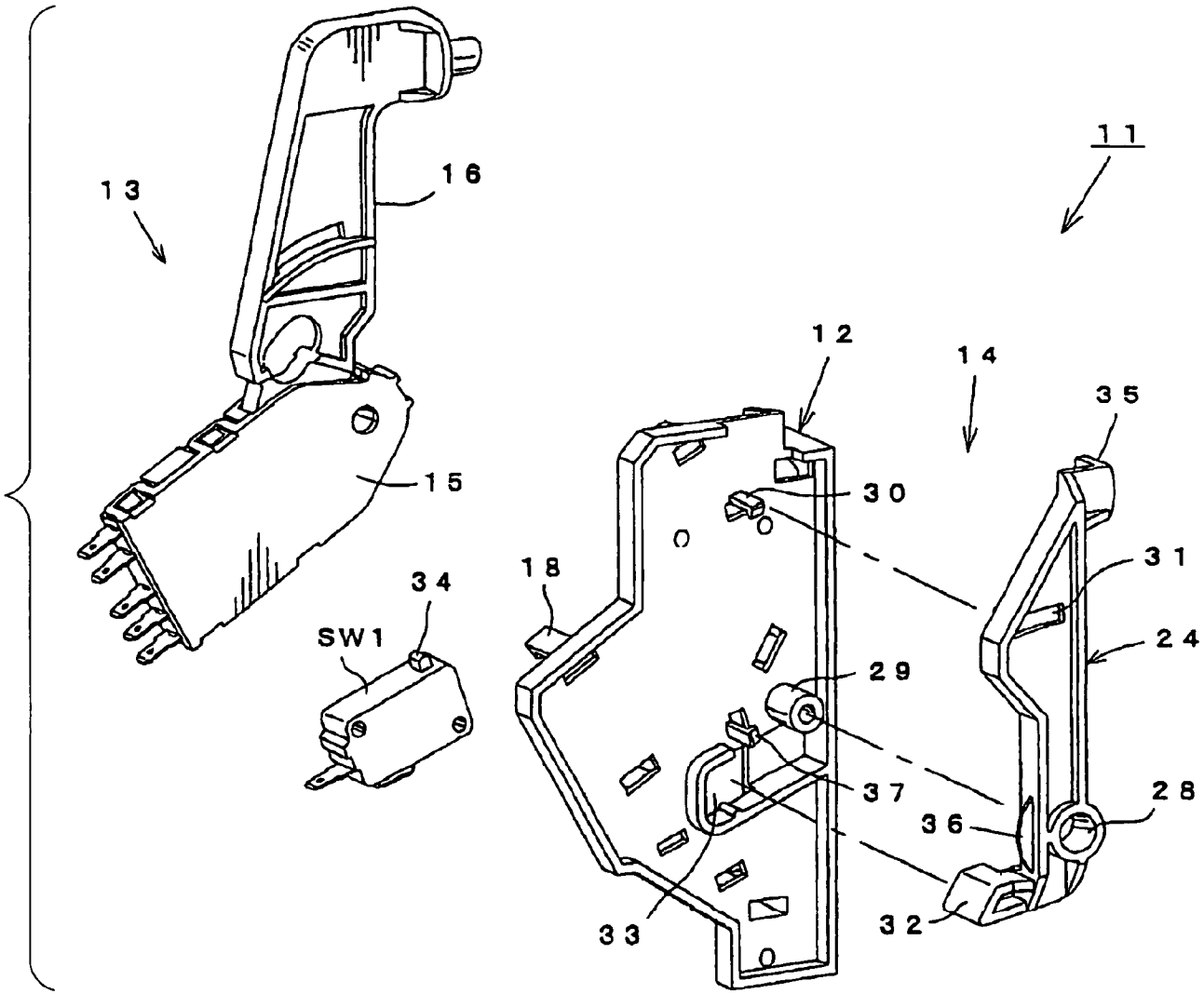
FIG. 4 is an exploded perspective view of the microwave oven door switch taken from the side of the other wall.

The above-mentioned second tilting lever 24 is L-shaped and is pivoted by tiltably inserting a fulcrum shaft 29 protruding from the other wall of the switch base 12 through a pivot hole 28 provided in the bent position of the L-shape as shown in FIG. 4, and a tilt-permitting nail 30 protruding from an upper part of the other wall of the switch base 12 engages a tilt guide groove 31 on the lever 24 to support the second tilting lever 24 on the switch base 12 such that the lever will not come off.

Further, a third cam 32 protruding from the lower end of the second tilting lever 24 formed in the L-shape is inserted through a horizontal through hole 33 in the switch base 12 and is disposed so as to face a top surface of a push button 34 on the latch switch SW1 mounted on the first wall, the second tilting lever 24 is tilted about the pivot hole 28 serving as a fulcrum of tilting when a pressure-receiving piece 35 serving as a second lever pressure-receiving portion protruding at an upper end of the lever receives an external force from the door key to be described later (a closing force to close the door) exerted on. At this time, a third cam 32 for a switching operation protruding at the lower end of said lever 24 urges the push button 34 on the latch switch SW1 to perform a switching operation. When released from the press, the tilting lever 24 is tilted back to the initial position under a returning action of the push button 34, and the latch switch SW1 is also switched back to the initial state.

The tilt of a tilt guide piece 36 protruding from the second tilting lever 24 in the form of a semi-circle concentric with the pivot hole 28 is guided by a tilt guide nail 37 protruding from the lower part of the other wall of the switch base 12 to guide the tilt of the lever 24.

Figure 5:
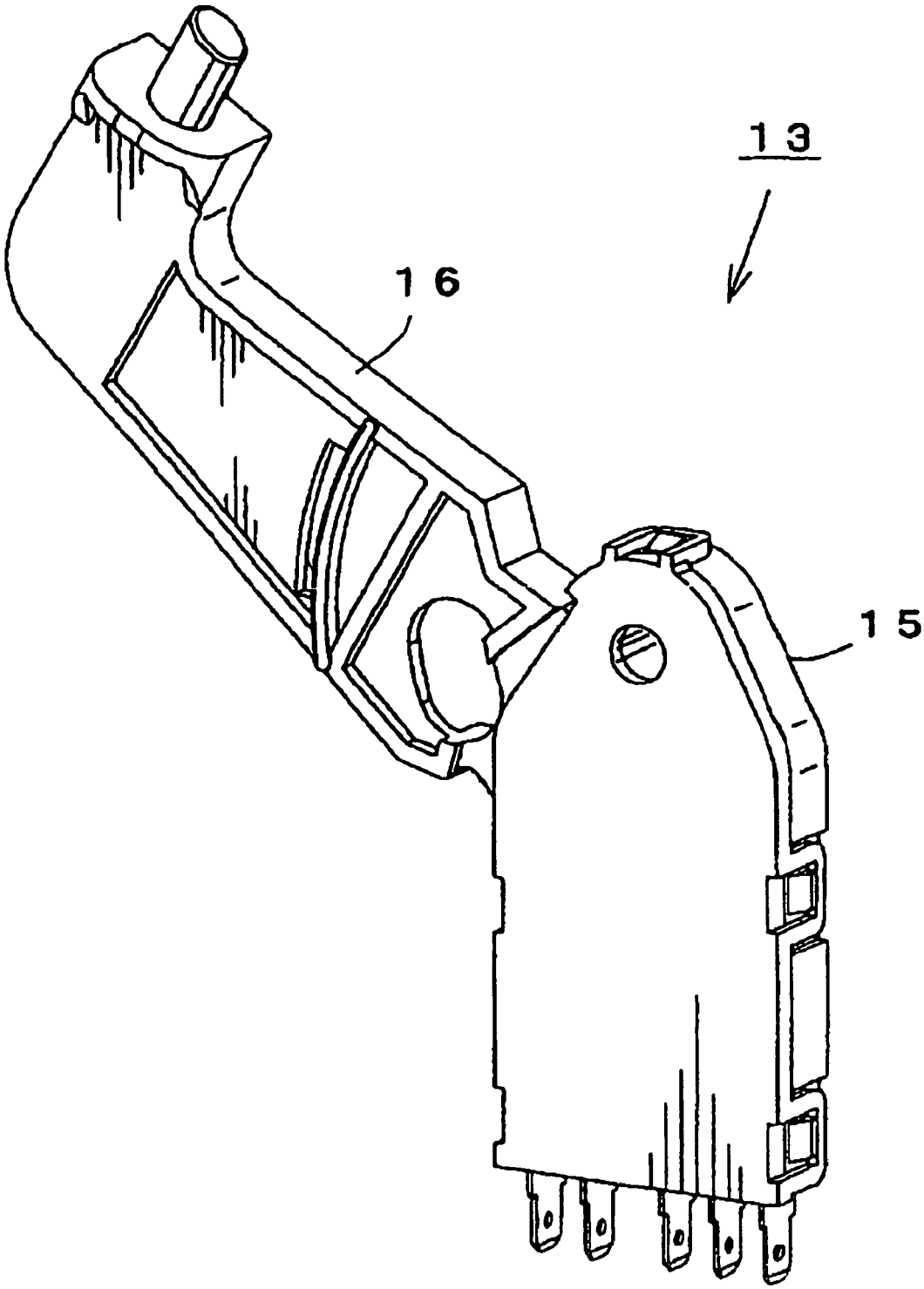
FIG. 5 is an external perspective view showing a switch unit.

FIG. 5 is an external view of the switch unit 13 which is provided by incorporating the lower end of the first tilting lever 16 in the switch case 15 to integrate them.

In this case, the switch unit 13 can be treated as a single unit although it comprises two components, i.e., the switch case 15 and the first tilting lever 16, and the switch unit 13 can be fabricated separately in advance. Therefore, said switch unit 13 and the door switch for a microwave oven can be easily assembled, fabricated, and managed, and freedom in selecting the quality of the materials will be increased. The components may be fabricated using different resin materials, e.g., using a thermosetting resin having high heat resistance for a case main body and a case cover and using an inexpensive thermoplastic resin for the switch base 12.

Figure 6:
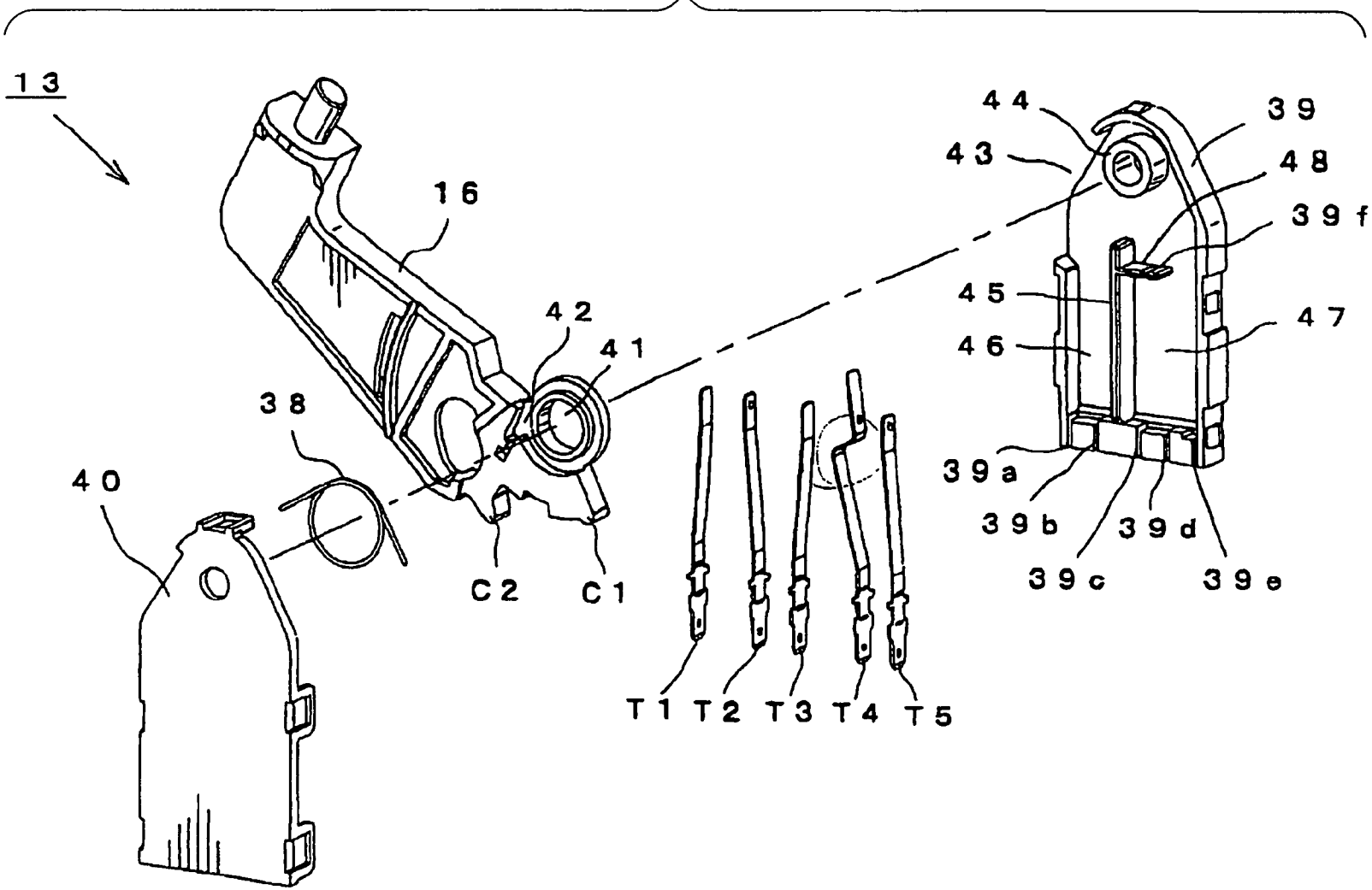
FIG. 6 is an exploded perspective view showing an internal structure of the switch unit.

Referring to the internal configuration of the switch case 15, as shown in FIG. 6, it includes the first tilting lever 16, a return spring 38, first to fifth terminals T1 to T5, a case main body 39 incorporating those components, and a case cover 40 in the form of a flat plate covering an open side of the main body.

The above-mentioned first tilting lever 16 has a pivot hole 41 at a lower end thereof that is incorporated in the case main body 39 to be described later for tiltably pivoting the lever, a spring mount 42 for mounting an annular return spring 38 for urging said lever 16 to support it in a standby position, and a first cam C1 and a second cam C2 for switching operations.

Referring to the case main body 39, a side of a recess, which is an opening on one side of the body, is partially opened for mounting the lever. A tilting fulcrum shaft 44 is protruded on an inner surface of the recess facing the opening 43. The shaft is inserted through the pivot hole 41 of the first tilting lever 16 to mount the lever in a tiltable manner. The first tilting lever 16 is tilted about the tilting fulcrum shaft 44 serving as a fulcrum of tilting in a range in which a switching operation can be performed.

Figure 7:
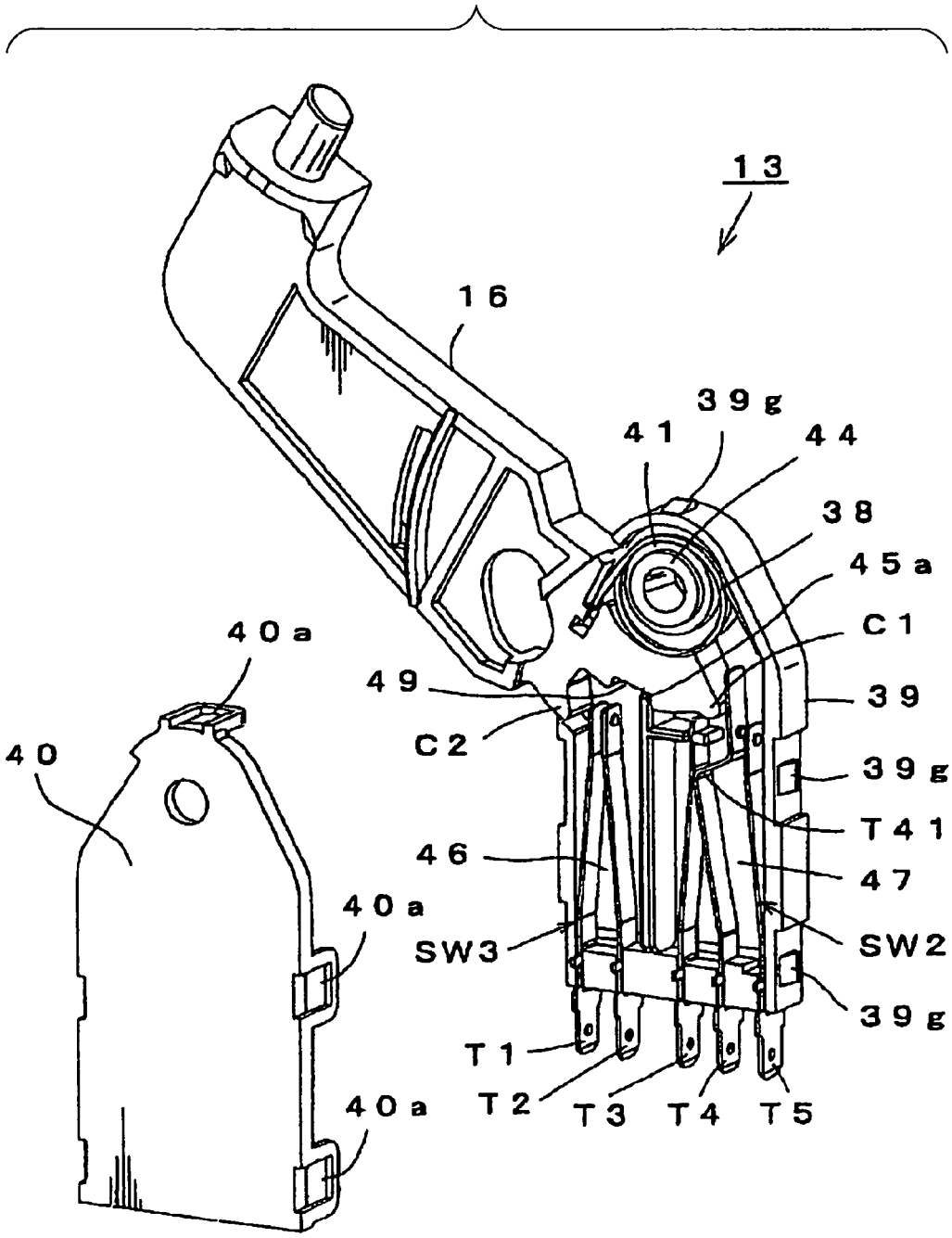
FIG. 7 is a perspective view showing a state of assembly of the switch unit.
Figure 8:
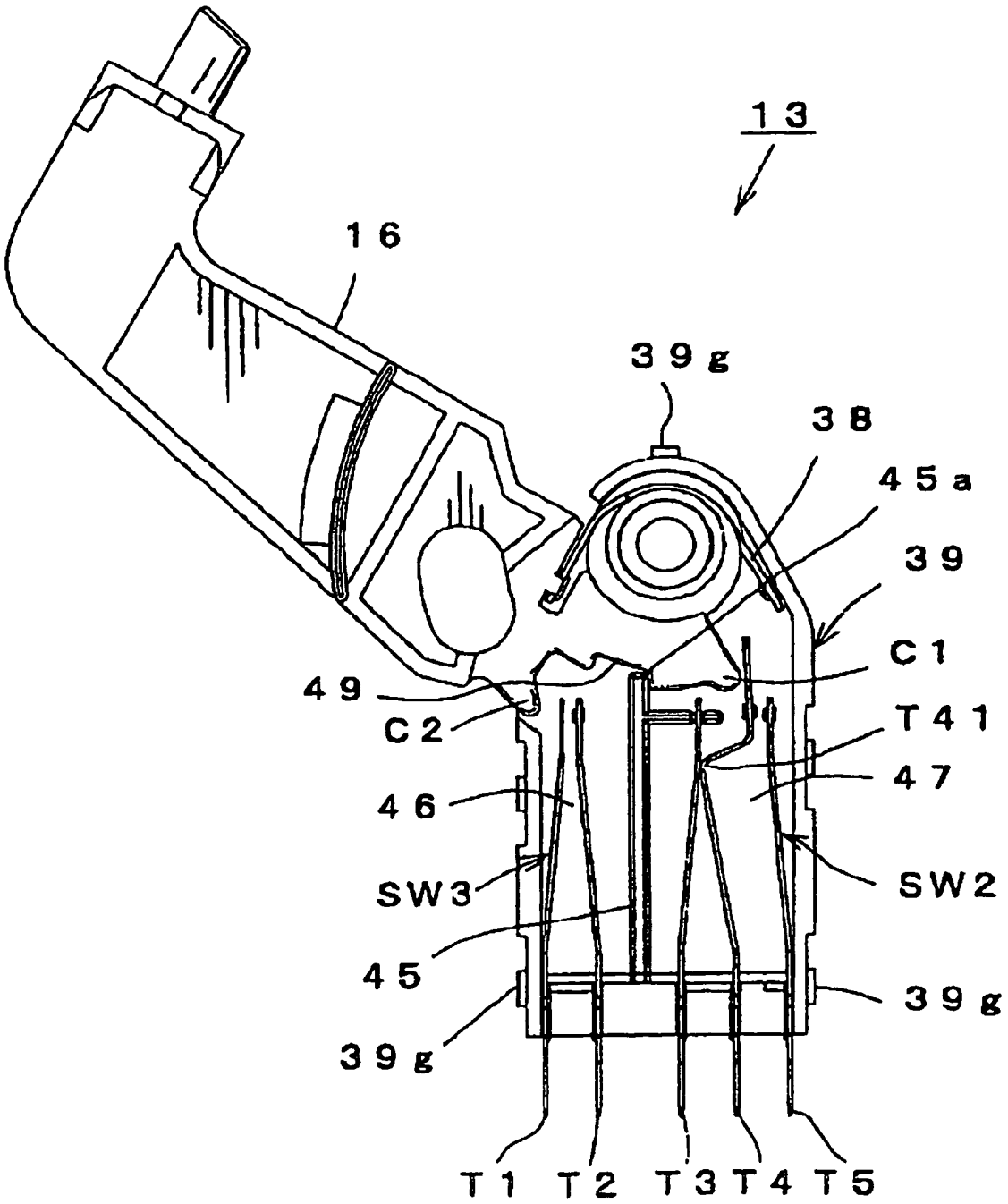
FIG. 8 is a front view showing a contact structure in the switch unit.

Next, an internal structure of the switch unit 13 will now be specifically described. FIGS. 7 and 8 show how the unit is incorporated in the case main body 39. The case main body 39 is partitioned in the middle thereof by a partition plate 45 extending in the vertical direction to provide left and right cavities 46 and 47, and a door switch SW3 and a monitor switch SW2 are disposed side by side in the order listed in the cavities 46 and 47. The second cam C2 and the first cam C1 of the first tilting lever 16 are located above the cavities in association therewith.

First, the door switch SW3 is constituted by the first terminal T1, the second terminal T2, and the second cam C2. Lower parts of the first and second terminals T1 and T2, which are conductive plate spring pieces in the form of elongate rectangular plates, are press-fit into press-fit grooves 39*a* and 39*b* formed on one side of a lower part of the case main body 39 (the left side in the figure). The two terminals T1 and T2 are mounted such that outer ends thereof protrude in alignment with each other from a bottom surface of the case main body 39 to allow wiring and such that inner ends thereof face each other substantially in parallel with each other in the cavity 46 inside the case main body 39 to serve as a contact. Said second cam C2 faces the inner end of he first terminal T1, and a contact switching structure is thereby provided, which is turned on/off when the inner end (free end) of the first terminal T1 is put in contact with the inner end (free end) of the second cam C2 or moved away from the same in accordance with a movement of said second cam C2.

The monitor switch SW2 is constituted by the third terminal T3, the fourth terminal T4, the fifth terminal T5, and the first cam C1. The third to fifth terminals T3 to T5, which are conductive plate spring pieces in the form of elongate rectangular plates, are press-fit into press-fit grooves 39*c* to 39*e* formed on the other side of the lower part of the case main body 39 (the right side in the figure). Outer ends of the three terminals T3 to T5 are protruded in alignment with each other from the bottom surface of the case main body 39 to allow wiring, and inner ends thereof face each other substantially in parallel with each other in the cavity 47 inside the case main body 39 to serve as contacts.

Further, a terminal holding piece 48 extends from the partition plate 45 into the cavity 47 on the side of the monitor switch SW2, and the inner end of the third terminal T3 is press-fit and secured in a press-fit groove 39*f* on the terminal holding piece 48. A bent part T41 of the fourth terminal T4 whose inner end is formed in a step-like configuration is put in contact with the inner end of the third terminal T3. The first cam C1 is associated with the free end beyond the bent part T41 to provide a contact switching structure in which the free end of the fourth terminal T4 is moved away from the third terminal T3 and is thereafter put in contact with the free end of the fifth terminal T5 according to movements of the first cam C1 to switch the contacts.

As thus described, the first terminal T1 and the fourth terminal T4 are equivalent to movable terminals for switching contact portions and are elastically displaced under an urging force of the first cam C1 and the second cam C2 formed on a bottom surface of the first tilting lever 16 which will be described later. The first to fifth terminals T1 to T5 are identical in configuration except the fourth terminal T4 and are interchangeable because they are identical components except that they are press-fit and mounted to the case main body 39 in different directions.

Further, the first tilting lever 16 between the first cam C1 and the second cam C2 is cut to form a stopper groove 49 thereon, and the stopper groove 49 is anchored at an apical part 45*a* of the partition plate 45 located below the same, the apical part 45*a* serving as a stopper portion. The amounts of operation of the cams caused by a tilt of the first tilting lever 16 are set by the length of the stopper groove 49.

After the first tilting lever 16, the return spring 38, and the terminals T1 to T5 are incorporated in the recess of the case main body 39, anchoring nails 40*a* on the case cover 40 are engaged and connected with anchoring protrusions 39*g* protruding from both sides and top of the case main body 39 to couple those elements such that the open side of the case main body 39 is closed.

Figure 9:
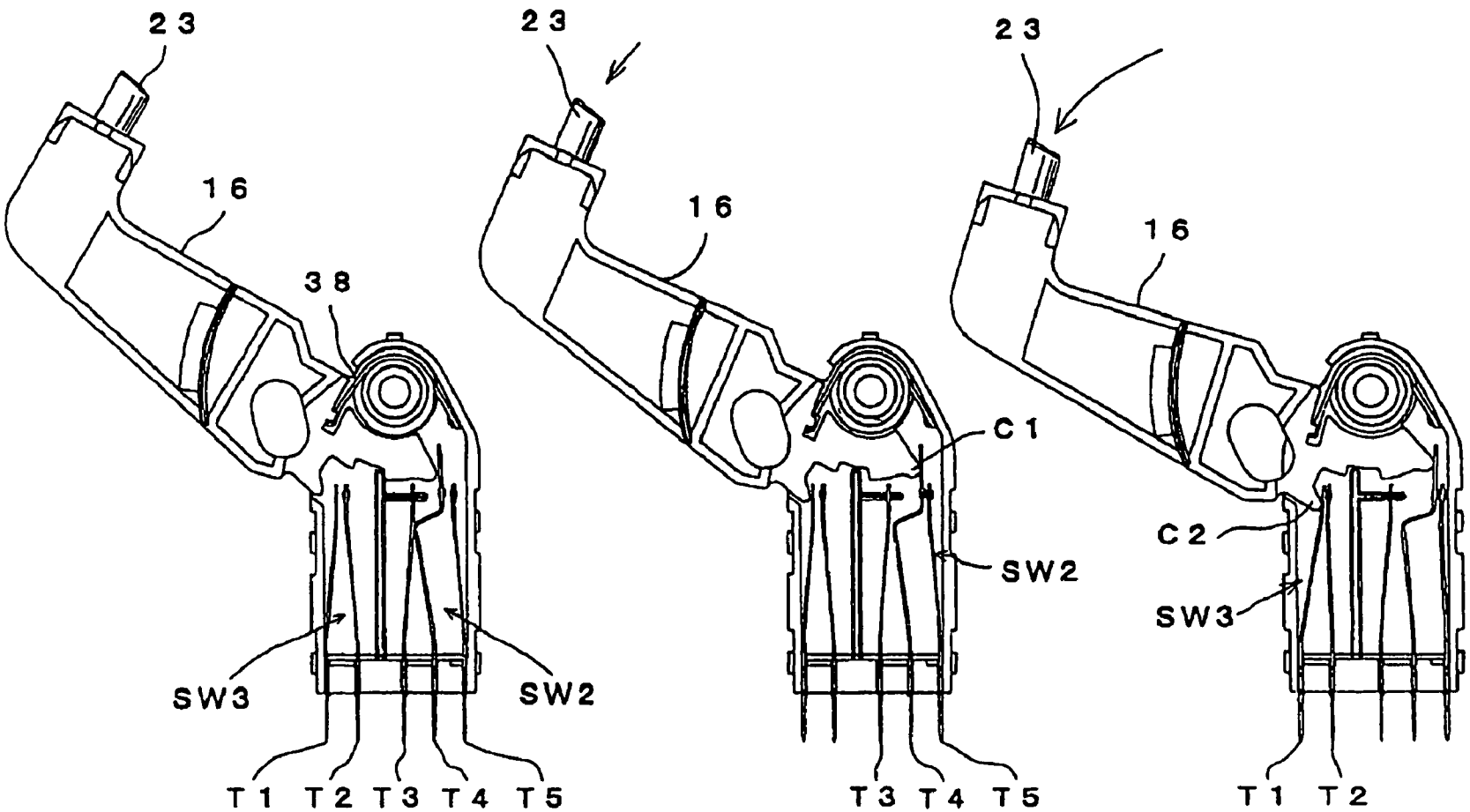
FIG. 9 is an illustration of an operation showing states of contact switching in the switch unit.

An operation of switching the contact portions of the microwave oven door switch 11 will now be described with reference to FIG. 9.

Normally, when the pressure-receiving protrusion 23 of the first tilting lever 16 is not pressed down as shown in FIG. 9(A), the first tilting lever 16 is urged by the return spring 38, and the pressure-receiving protrusion 23 is in a standby state in which it can be pressed down. At this time, in the monitoring switch SW2, the fourth terminal T4 contacts the fifth terminal T5 to establish a normally closed contact or a conductive state, and the terminal does not contact the fifth terminal T5 to establish a normally open contact or a non-conductive state.

In the door switch SW3, the first terminal T1 and the second terminal T2 do not contact to establish a normally open contact or a non-conductive state.

When the pressure-receiving protrusion 23 begins to receive an external force to cause an initial tilt of the first tilting lever 16 as shown in FIG. 9(B), the first cam C1 integral with the first tilting lever 16 pushes the free end of the fourth terminal T4 to elastically displace it in the direction of moving away from the contact portion of the third terminal T3. As a result, the contact portions of the third terminal T3 and the fourth terminal T4 are moved away from each other to become non-conductive. Thereafter, the fourth terminal T4 is pressed against the contact portion of the fifth terminal T5 located in face-to-face relationship therewith in the direction of displacement to become conductive.

When the first tilting lever 16 is further tilted, as shown in FIG. 9(C), the second cam C2 presses the free end of the first terminal T1 to elastically displace the same. As a result of the elastic displacement, the first terminal T1 is pressed against the contact portion of the second terminal T2 to become conductive, and the door switch SW3 is switched to a closed position.

The pressure-receiving piece 35 of the latch switch mechanism 14 in a standby position that is set back from said pressure-receiving protrusion 23 is pushed by the first tilting lever 16 at a time lag. Thus, the first tilting lever 16 and the second tilting lever 24 are pushed in the order listed, and the third cam 32 pushes down the push button 34 of the latch switch SW1 when the second tilting lever 24 is tilted.

When the external force on the first tilting lever 16 is removed, the first tilting lever 16 receives the returning force of the return spring 38 to return to the initial depressed standby position, and the terminals T1 and T4 on both sides of the same which have been elastically displaced also elastically return to the initial positions to return the contact portions to the initial standby state shown in FIG. 9(A).

Similarly, the external force on the second tilting lever 24 is removed substantially at the same time, and the second tilting lever 24 receives a returning force of the push button 34 to return to the initial depressed standby position, and the contact portions are switched from on to off and are returned to the initial standby state.

Since the monitor switch SW2 and the door switch SW3 provided side by side are disposed in fixed positions on both sides of the interior of the unit case 15 as thus described, there will be no variation in their mounting positions. Further, the switches SW2 and SW3 on both sides can be easily provided with an arbitrary contact switching configuration in which the contact switching timing of one of the switches, i.e., the monitor switch SW2 according to the movement of the first tilting lever 16 is different from the contact switching timing of the other switch, i.e., the door switch SW3, Therefore, the contact portions of each switch can be switched at accurate timing according to the tilting operation.

Since the two switches SW2 and SW3 can be incorporated in the single switch case 15, common components can be effectively used, and the device can be fabricated compactly. In particular, the first tilting lever 16 has both of lever function and cam function in spite of the fact that it is a single component, and it is a common component that allows both of the switches SW2 and SW3 to be switched through one tilting operation. It is therefore possible to reduce the number of components of the switches.

Figure 10:
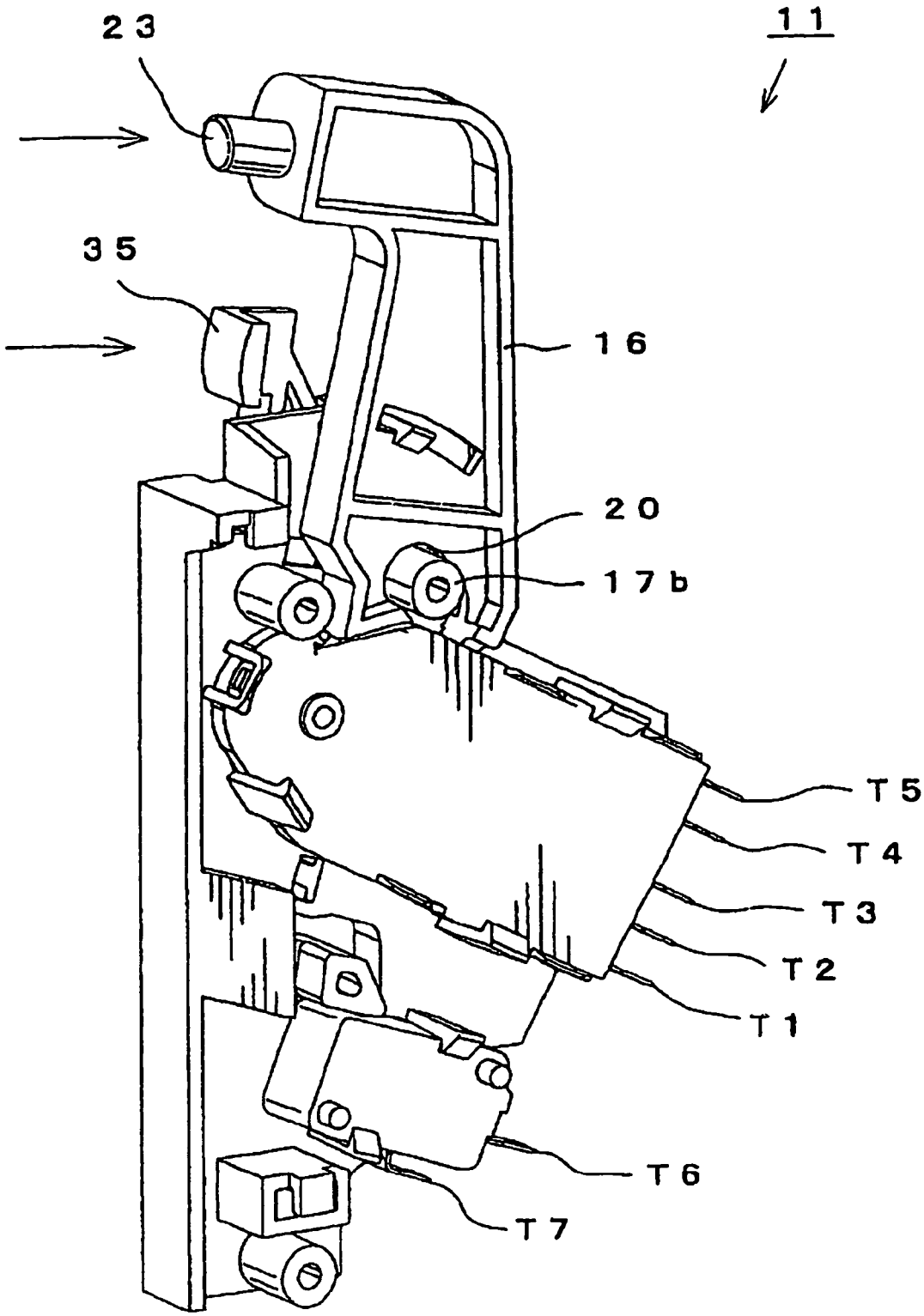
FIG. 10 is a perspective view showing a state of tilting of a first tilting lever and a second tilting lever.

Further, as shown in FIG. 10, the outer ends of the terminals T1 to T5 of the monitor switch SW2 and the door switch SW3 respectively are protruded in the same direction as outer ends of terminals T6 and T7 protruding from the bottom surface of the latch switch SW3. As a result, an arrangement can be chosen, in which the terminals are disposed in directions and positions that facilitate wiring operations, and the man-hour for wiring can therefore be reduced.

Further, referring to the first tilting lever 16 and the second tilting lever 24, the distances from the pivot portions where the levers are pivoted to the outer ends of the levers are longer than the distances from the pivot portions to the inner ends to set the leverage of the lever outer end of each of the tilting levers 16 and 24 that is tilted about the respective pivot portion greater than the leverage of the inner end of the lever.

Thus, a tilting force from the outer end of the lever tilting about the pivot portion may be small according to the principles of the lever, and the tilting force can be efficiently transferred to the inner end of the lever. Therefore, the first tilting lever 16 and the second tilting lever 24 have a small load resistance when tilted and can move smoothly.

Figure 11:
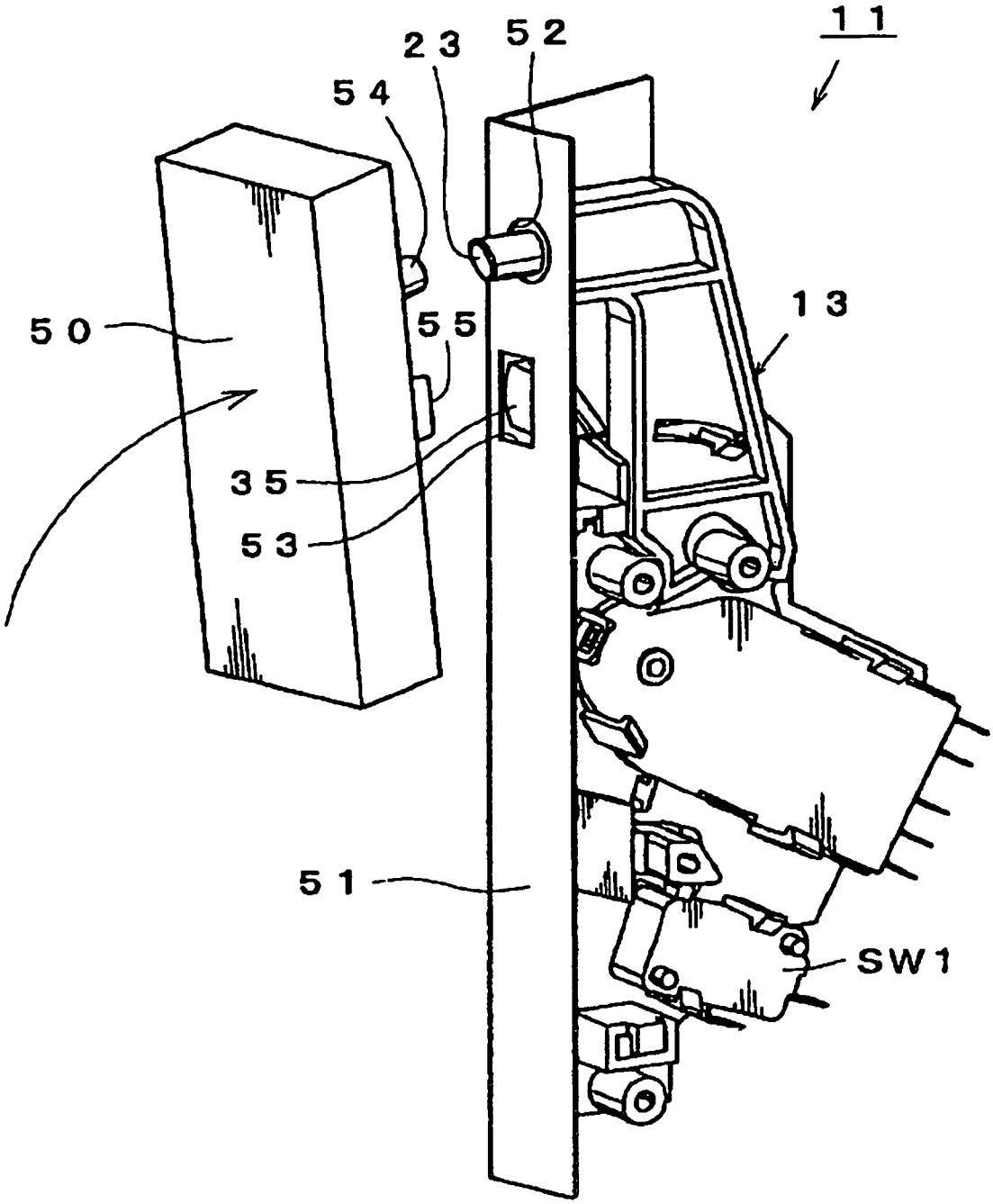
FIG. 11 is a perspective of a major part of the microwave oven door switch showing a state of assembly of the same.

FIG. 11 shows how a state of installation of the door switch 11 for a microwave oven having the switch unit 13. The microwave oven door switch 11 is mounted such that the pressure-receiving protrusion 23 of the first tilting lever 16 faces an upper window 52 formed in an upper part of a main body frame 51 facing a door key 50 on a vertically opening door of a microwave oven and such that the pressure-receiving protrusion 35 of the second tilting lever 24 faces a lower window 53 formed under the same.

An upper nail 54 and a lower nail 55 are protruded from an upper part of the side of the door key 50 facing the windows, and the pressure-receiving protrusion 23 and the pressure-receiving protrusion 35 are urged as the door is opened and closed to move back and forth, whereby switching operations are performed.

In this case, the first tilting lever 16 is mounted such that the tilting direction of the same agrees with the direction (the horizontal direction in the figure) of the external force applied during a switching operation (when the door is closed). Thus, the first tilting lever 16 is obliquely pushed down and tilted when it receives the external force, and the contacts of the switches SW2 and SW3 on both sides thereof are accurately switched in conjunction with the tilting motion of the first tilting lever 16.

Figure 12:
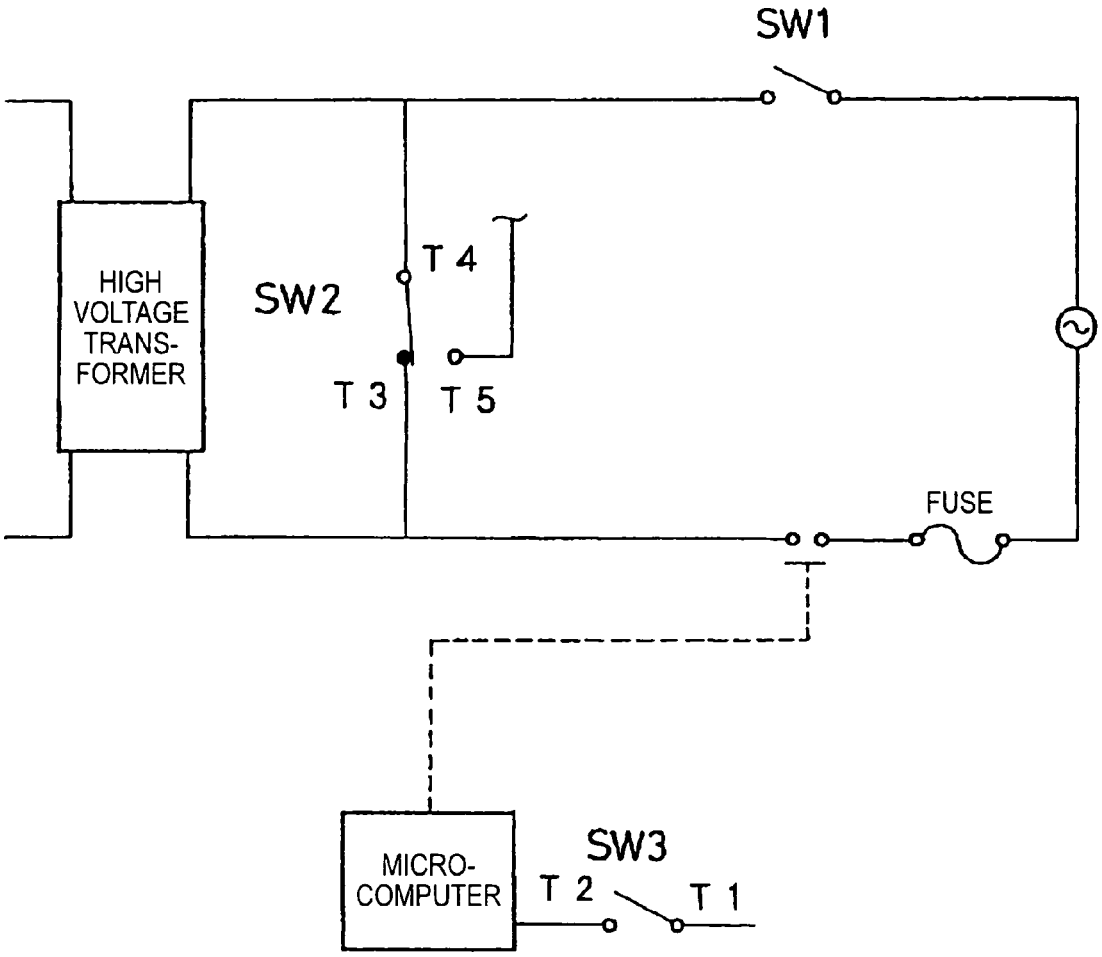
FIG. 12 is an electrical circuit diagram of the microwave oven door switch.

FIG. 12 shows an electrical circuit diagram of the door switch for a microwave oven. The terminals of each of the switches SW1, SW2, and SW3 constituting the door switch 11 for a microwave oven are connected to a circuit in the microwave oven as illustrated.

Figure 13:
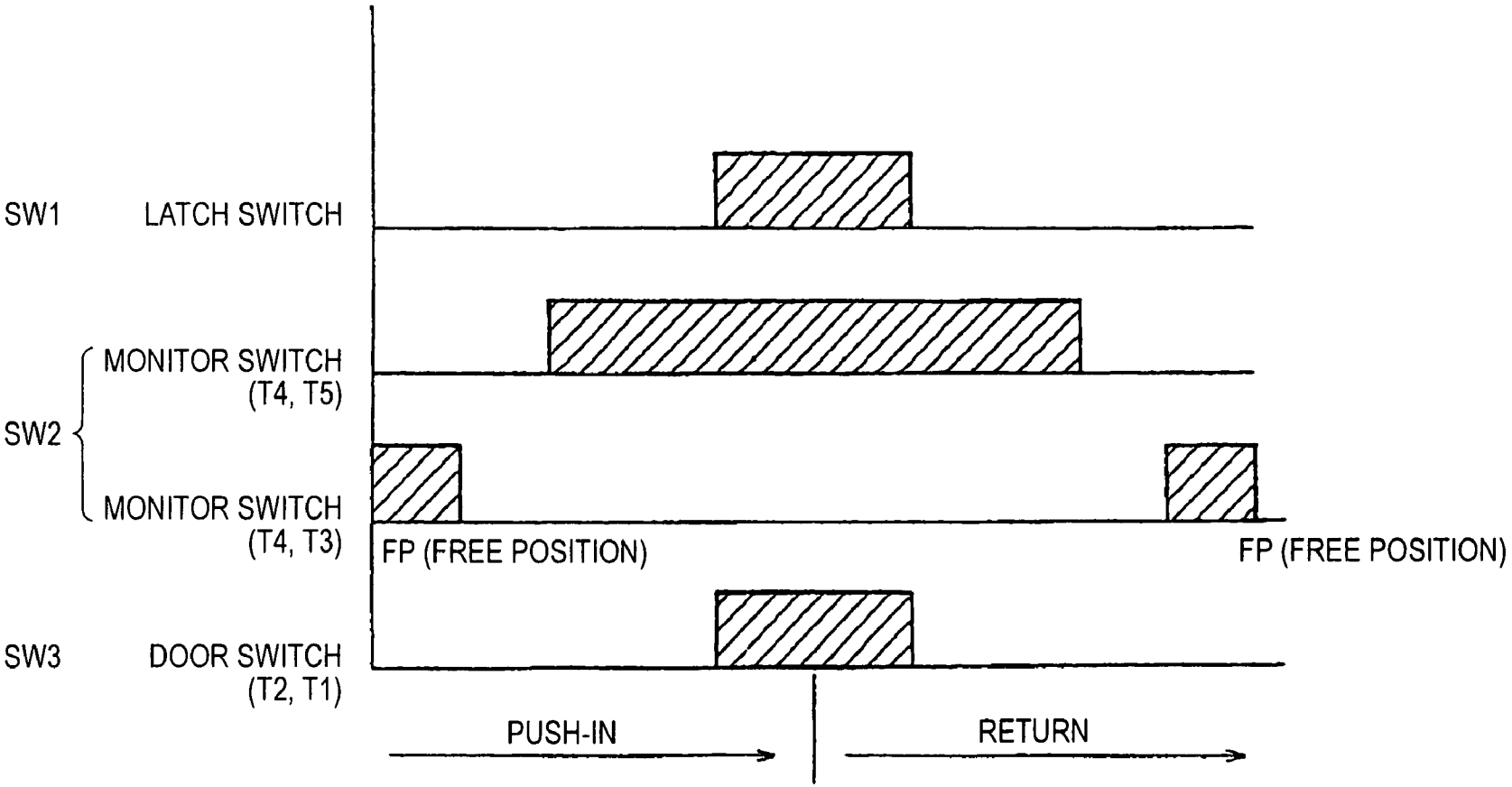
FIG. 13 is a time chart for the microwave oven door switch.

FIG. 13 shows a time chart for each of the switches SW1, SW2, and SW3 constituting the door switch 11 for a microwave oven. The latch switch SW1 and the door switch SW3 are kept open in the depressed standby state in which the door of the microwave oven is open, and a close signal is output when they are pushed down as the door is closed. On the contrary, the monitor switch SW2 is kept closed (the third terminal T3 and the fourth terminal T4 are in conduction) in the depressed standby state (in a free position) in which the door of the microwave oven is open and is opened when it is pushed down as the door is closed (the fourth terminal T4 and the fifth terminal T5 are in conduction). At this time, a cooking lamp of the microwave oven will be turned on, for example, by a signal output from the same.

The microwave oven is energized and enabled for cooking when the latch switch SW1 and the door switch SW3 are closed, and the operation is stopped when the switches are opened. However, in case that there is a problem at the contact portions of the switches SW1 and SW3 such as seizure of the contacts, the contact portions of the switches SW1 and SW3 may not be opened even when the door is opened. Since electromagnetic waves can be output from the microwave oven to cause a danger in such a case, a circuit configuration in employed, in which the normally closed contact of the monitor switch SW2 finally closes to short-circuit the power supply circuit and in which a fuse is thereby blown to disconnect the power supply. Safety is thus maintained.

Figure 14:
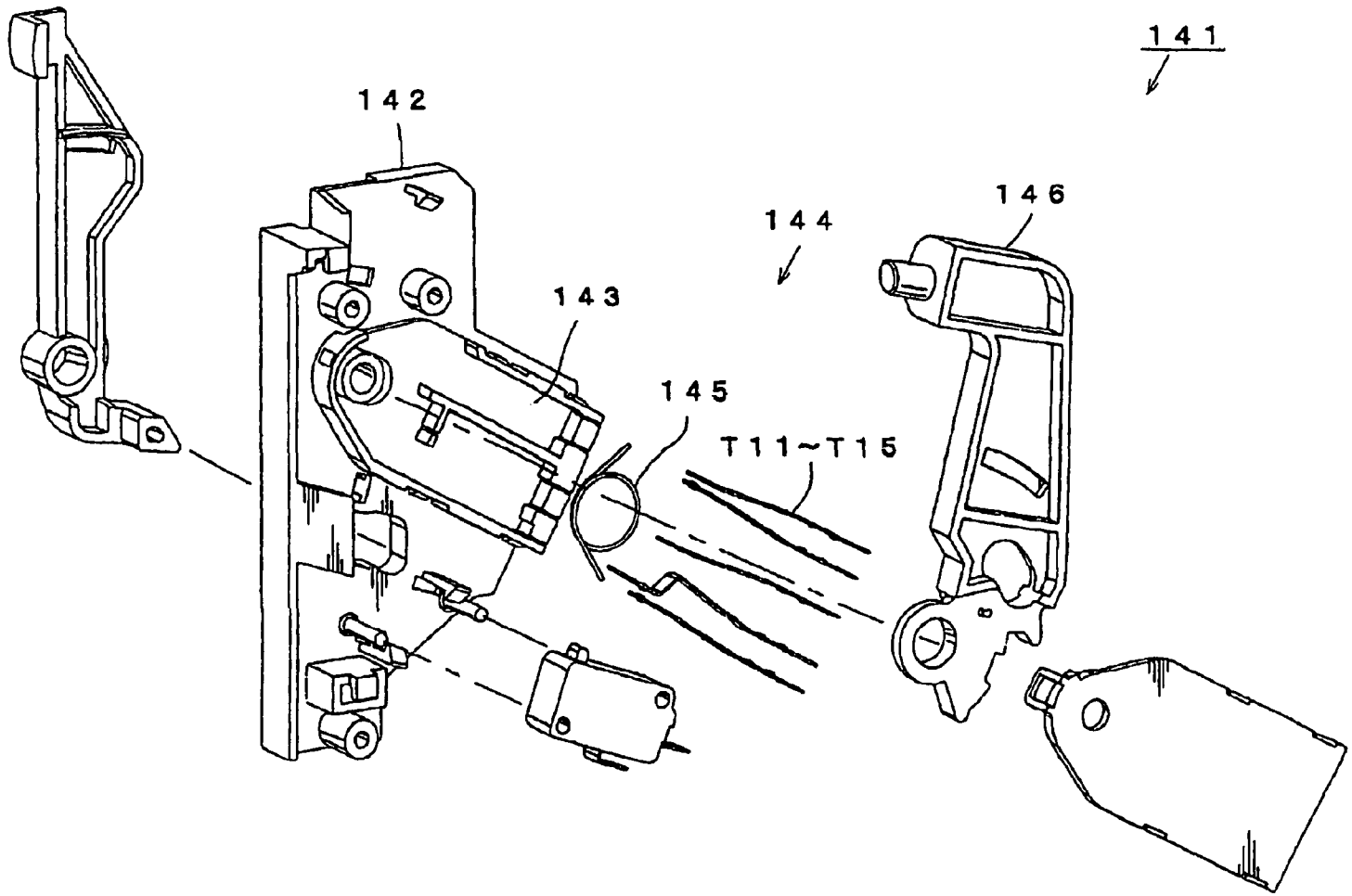
FIG. 14 is an exploded perspective view showing a state of another embodiment in which a switch base is used instead of a case main body.

FIG. 14 shows another embodiment of the door switch for a microwave oven. In the door switch 141 for a microwave oven, a switch housing portion 143 in the form of a recess similar to a case main body is formed on one wall of a switch base 142. A return spring 145, first to fifth terminals T11 to T15, and a first tilting lever 146 constituting a switch unit 144 are incorporated in the switch housing portion 143. The open side of the housing is closed with a case cover 147 to assemble the components integrally.

In this case, since a configuration can be employed in which the components constituting the switch are directly incorporated in the switch housing portion 143 formed on the switch base 142 in advance, a part of the switch base 142 can be used instead of a case main body. It is therefore possible to reduce the number of components.

Figure 15:
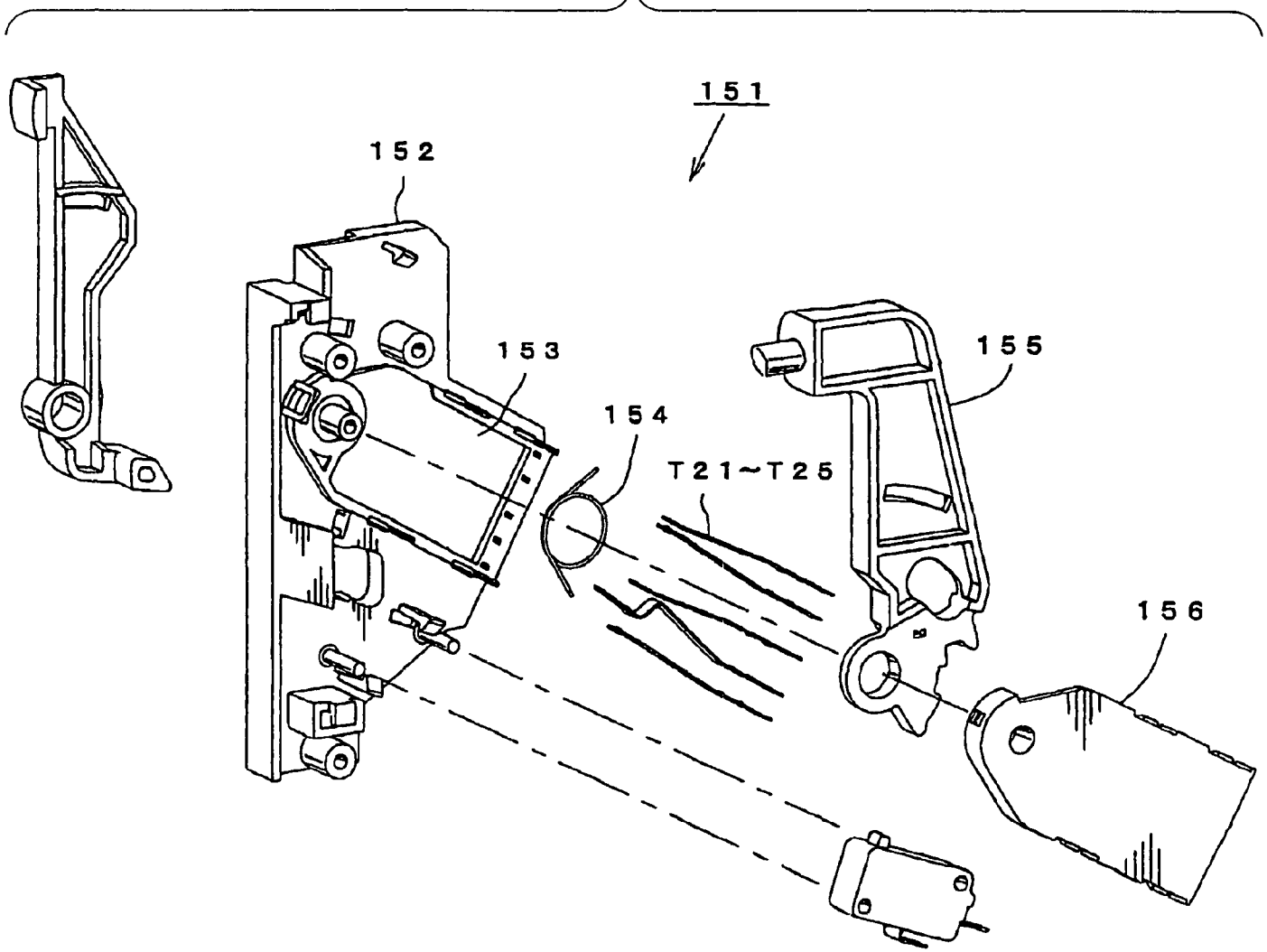
FIG. 15 is an exploded perspective view showing a state of another embodiment in which a switch base is used instead of a case cover.

FIG. 15 shows another embodiment of the door switch for a microwave oven. In the door switch 151 for a microwave oven, a cover portion 153 having the same shape as that of a case cover is formed on one wall of a switch base 152. A case main body 156 incorporating a return spring 154, first to fifth terminals T21 to T25, and a first tilting lever 155 is mounted to the cover portion 153.

In this case again, a part of the switch base 152 can be used instead of a case cover because the switch base 152 is formed with the cover portion 153 having the same shape as that of a case cover in advance. A switch unit can be formed only by mounting the case main body 156 to the same. It is therefore possible to omit a case cover and to reduce the number of components.

As described above, since it is possible not only to house two switches, i.e., a monitor switch and a door switch in a single switch case but also to switch both of the switches though a first tiling lever, the switch case and the first tilting lever can be used as common components. As a result, a cost reduction, space saving, and compactness can be achieved through a reduction in the number of components. Since the two switches are disposed in fixed positions in the switch case, there will be no variation of the mounting positions. Since a switching operation takes place in conjunction with a tilting operation, the switches can be operated at accurate timing, and reliable and stable switching operations can be achieved.

Second Embodiment

Figure 16:
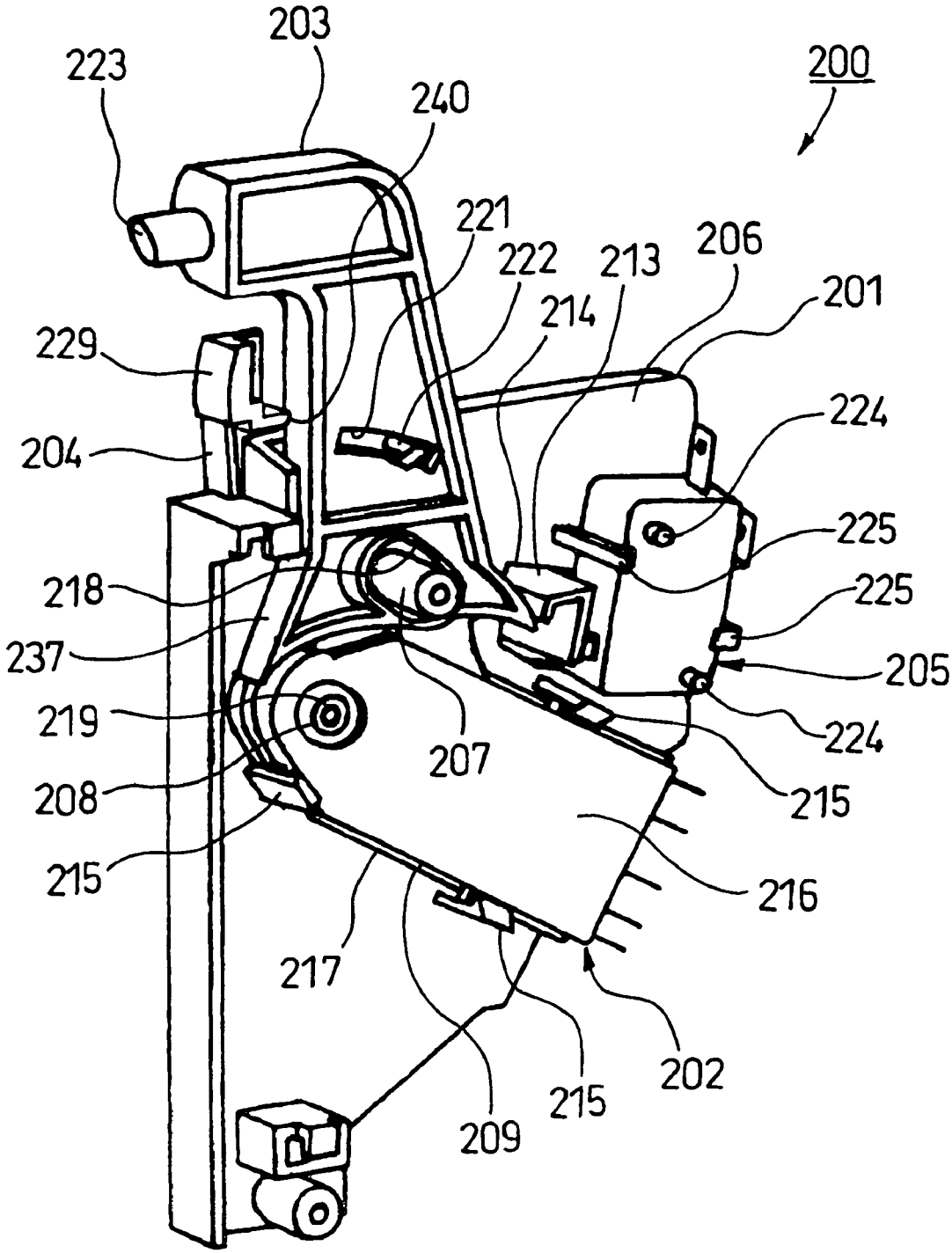
FIG. 16 is an external perspective view of a microwave oven door switch used in a high frequency heating apparatus of a second embodiment of the invention taken from one side thereof.
Figure 17:
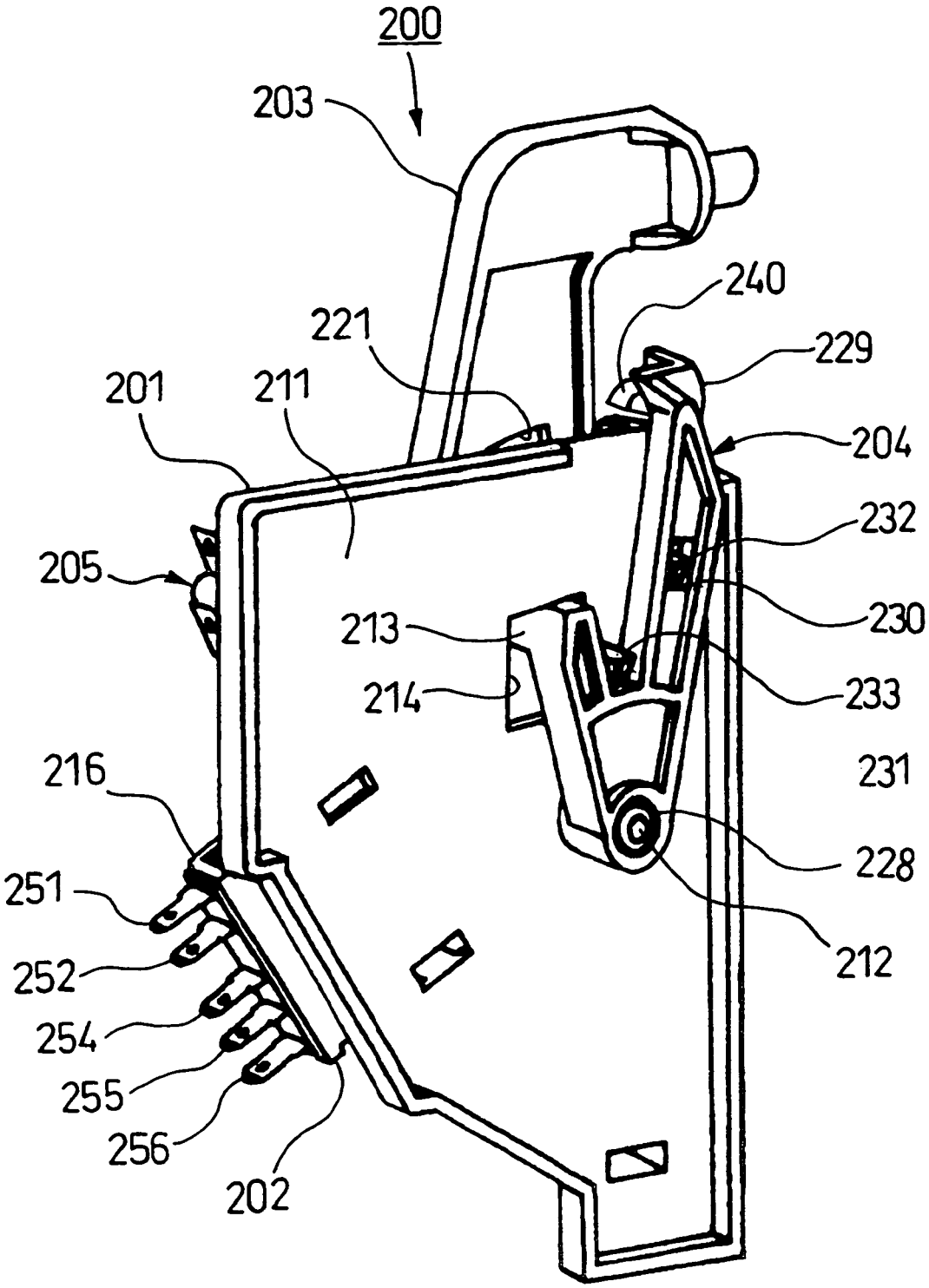
FIG. 17 is an external perspective view of the microwave oven door switch in FIG. 16 taken from another side thereof.
Figure 18:
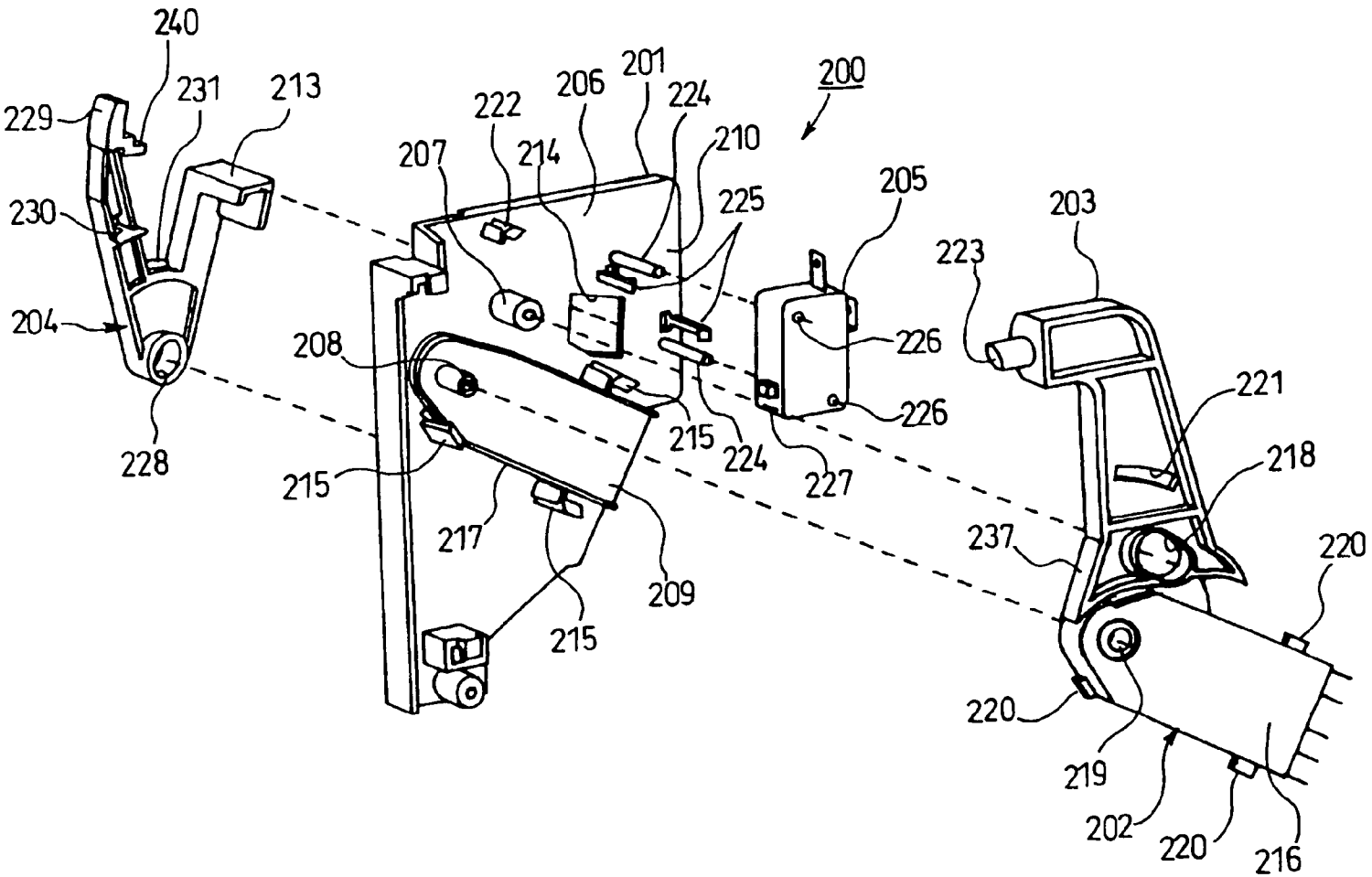
FIG. 18 is an exploded perspective view of the microwave oven door switch shown in FIG. 16.
Figure 19:
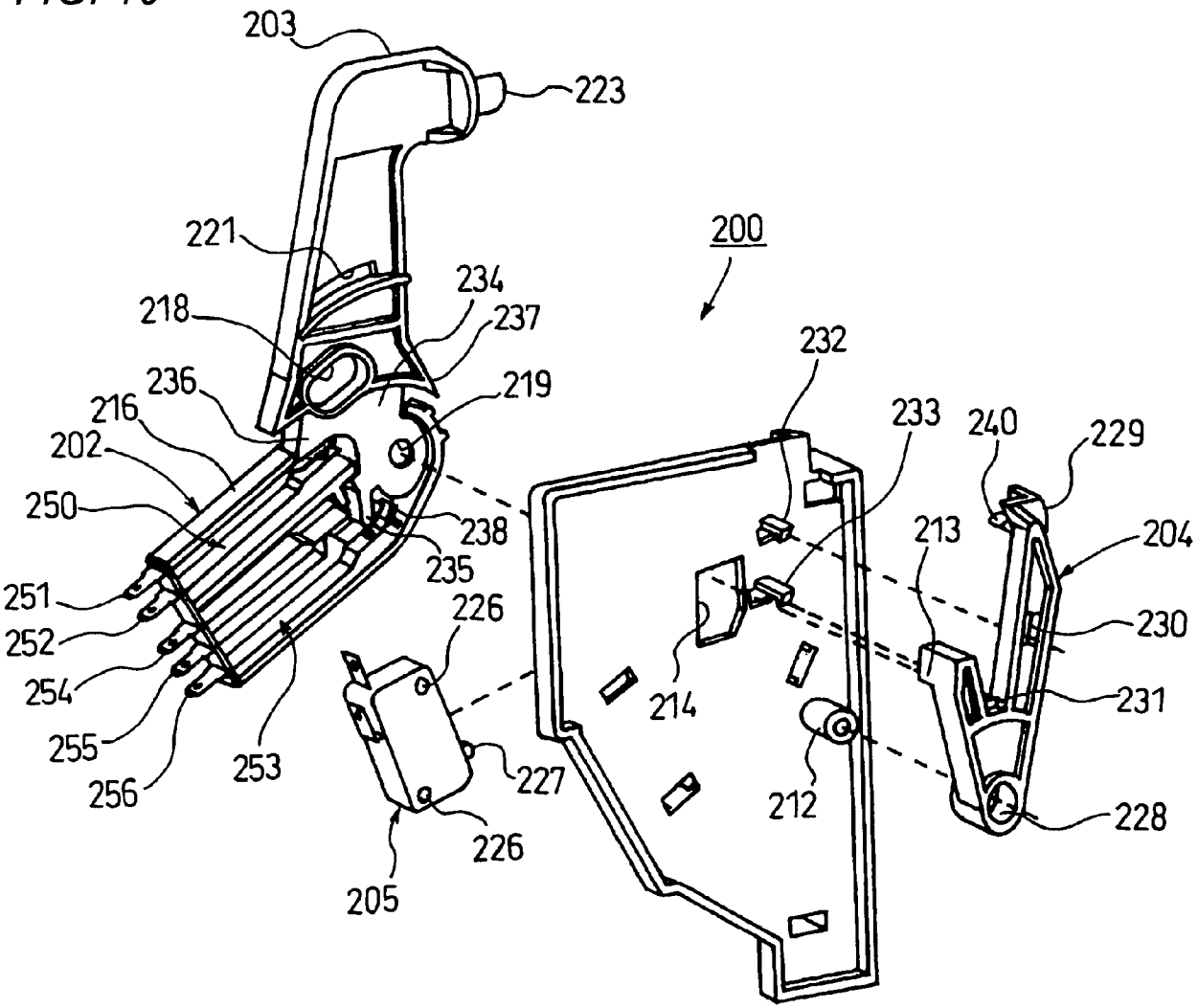
FIG. 19 is an exploded perspective view of the microwave oven door switch shown in FIG. 17.
Figure 20:
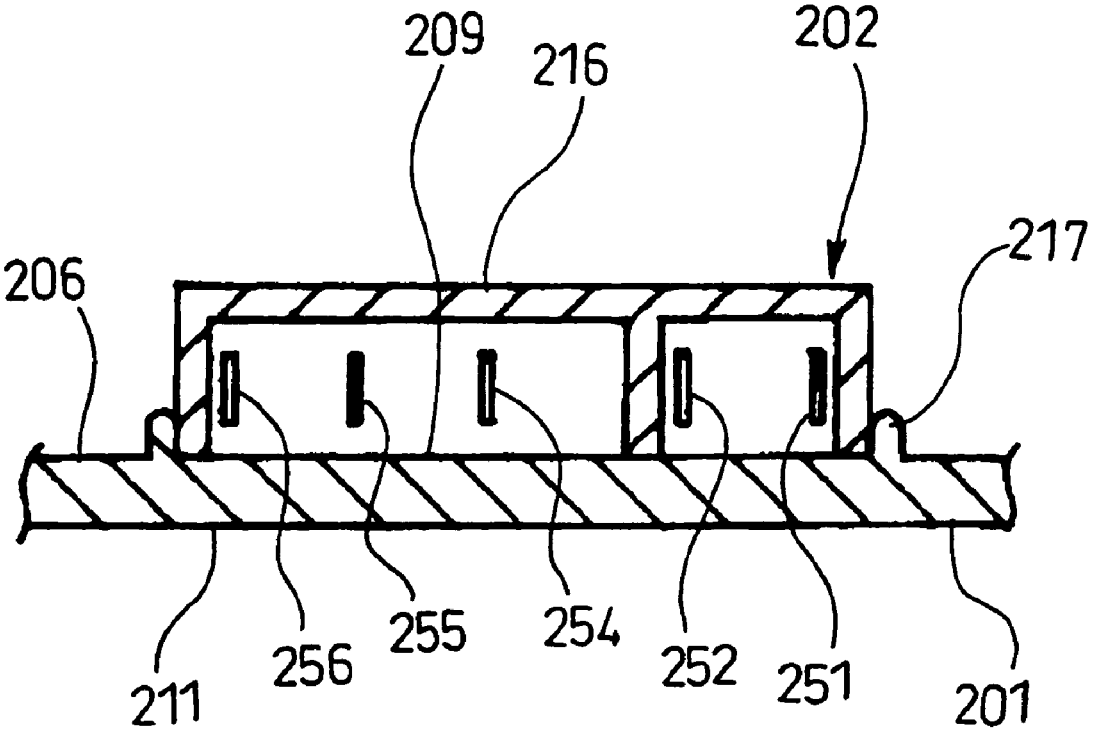
FIG. 20 is a sectional view of a main switch of the microwave oven door switch shown in FIG. 16.
Figure 21:
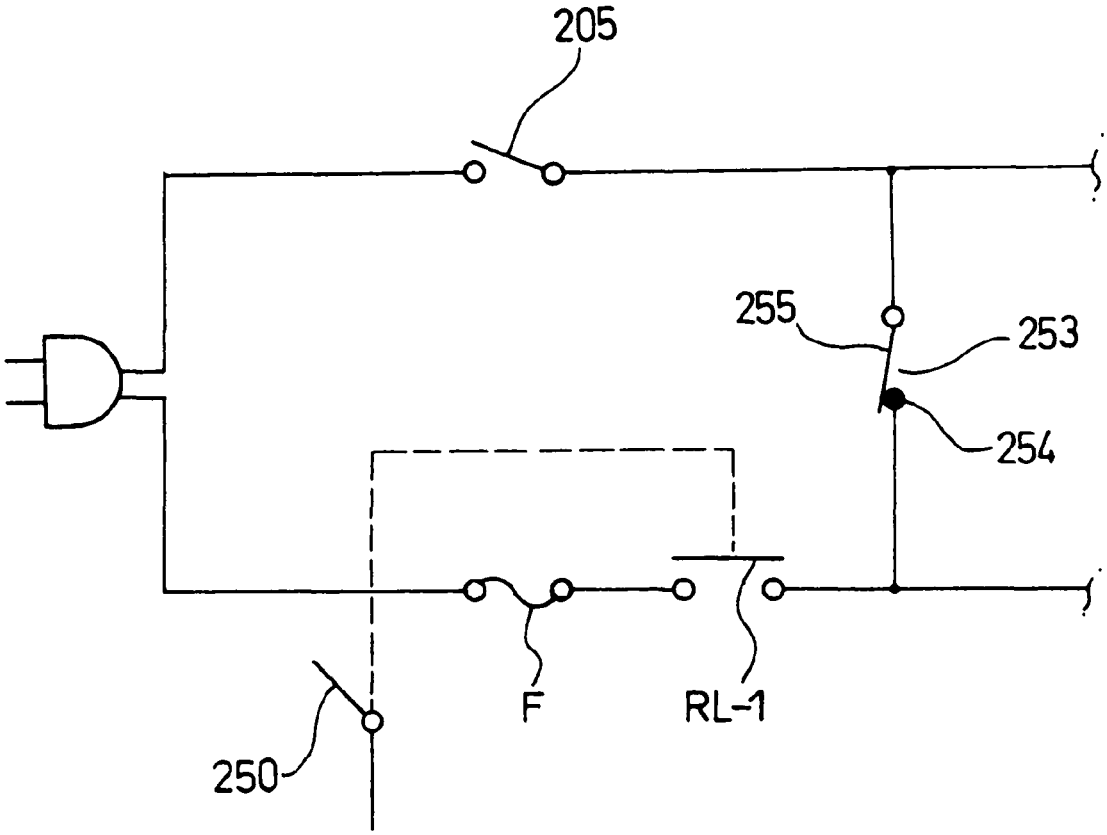
FIG. 21 shows an example of a problem in a circuit configuration.
Figure 22:
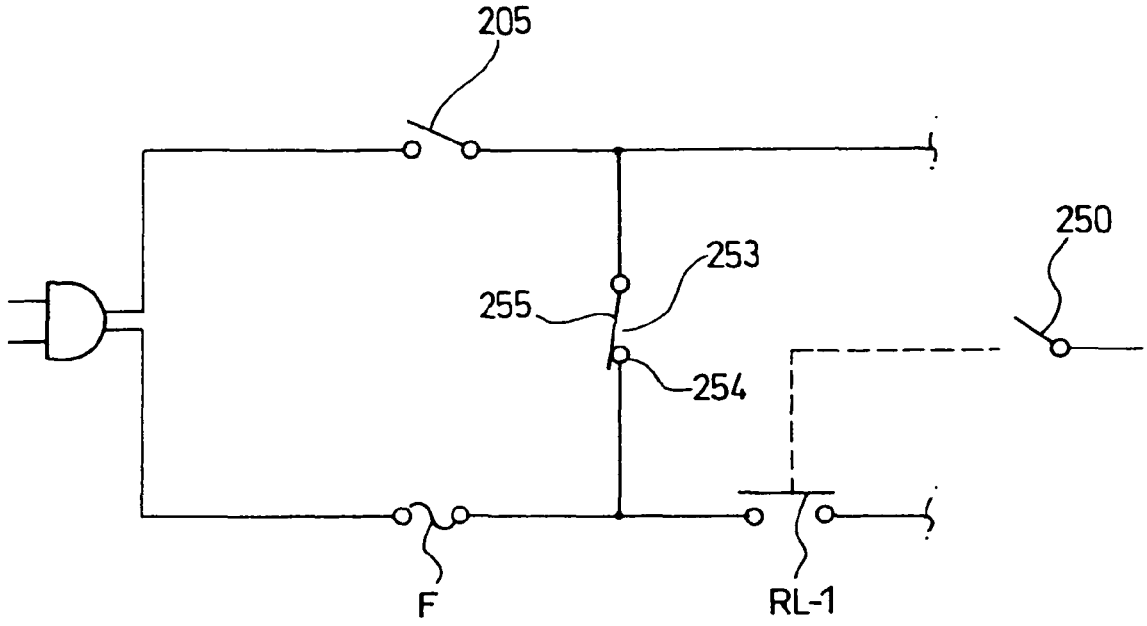
FIG. 22 is a circuit configuration diagram according to the invention.
Figure 23:
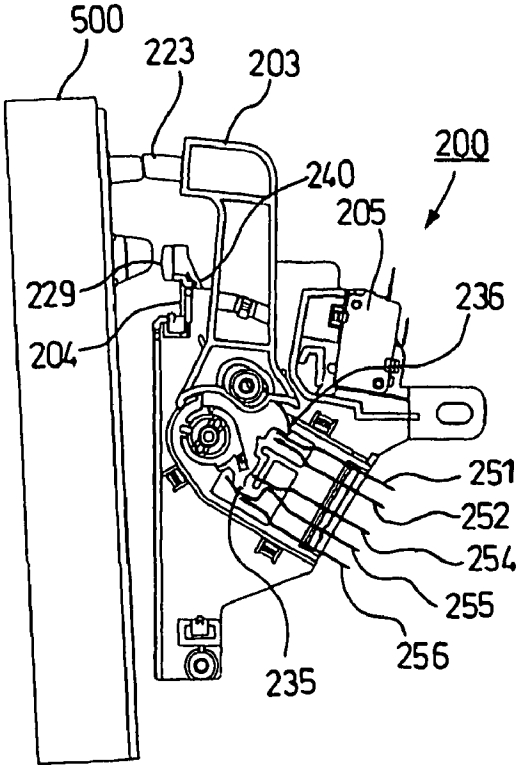
FIGS. 23(*a*)-(*c*), 24(*a*)-(*c*), and 25(*a*)-(*c*) are illustrations of operations in the second embodiment.
Figure 23:
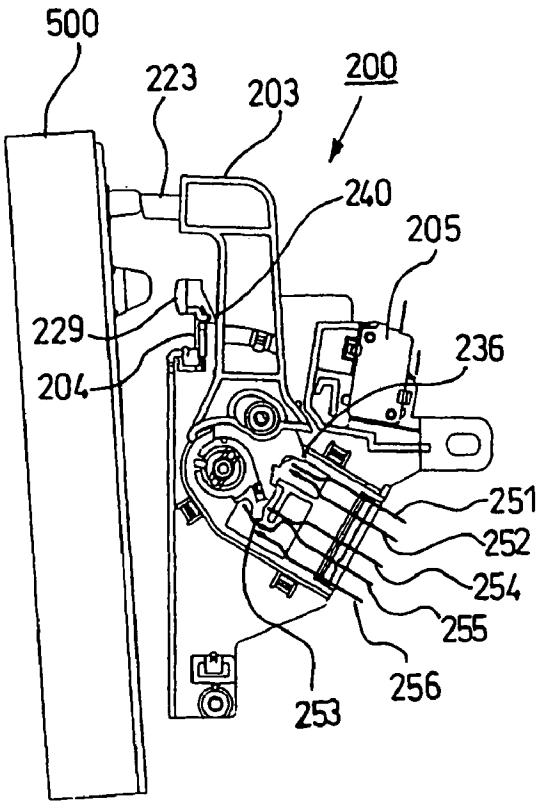
Figure 23:
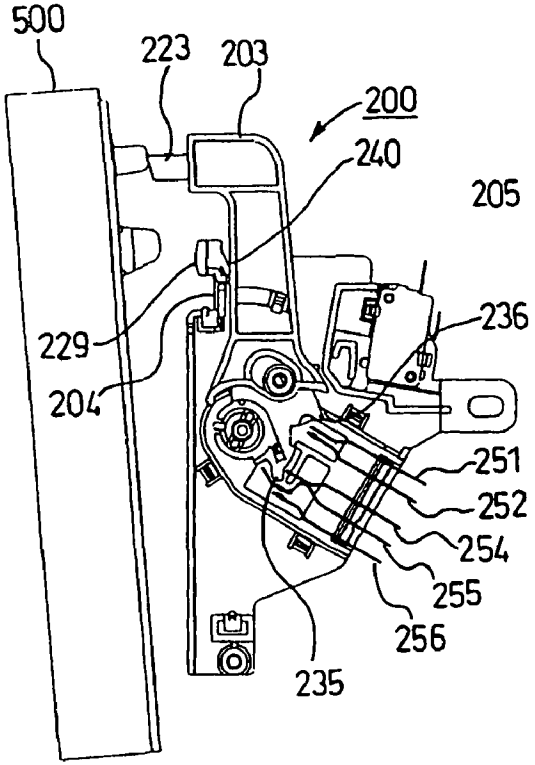

A second embodiment of a high frequency heating apparatus according to the invention will now be described with reference to FIGS. 16 to 23. FIG. 16 is an external perspective view of a door switch for a microwave oven used in the high frequency heating apparatus of the second embodiment taken from one side of the same. FIG. 17 is an external perspective view of the door switch for a microwave oven in FIG. 16 taken from another side of the same. FIG. 18 is an exploded perspective view of the door switch for a microwave oven shown in FIG. 16. FIG. 19 is an exploded perspective view of the door switch for a microwave oven shown in FIG. 17. FIG. 20 is a sectional view of a switch unit of the door switch for a microwave oven shown in FIG. 16. FIG. 21 shows an example of a problem in a circuit configuration. FIG. 22 is a circuit configuration diagram according to the invention. FIGS. 23(*a*)-(*c*), 24(*a*)-(*c*), and 25(*a*)-(*c*) are illustrations of operations. The description will be omitted or simplified for parts identical or equivalent to those in the first embodiment.

As shown in FIG. 16, a door switch 200 for a microwave oven used in a high frequency heating apparatus is constituted by a switch mounting plate 201, a switch unit 202 incorporating a first lever 203, a second lever 204, and a main switch 205 which is a second switch.

A protrusion 207 for mounting the first lever 203 and a rotary shaft 208 for rotatably supporting the first lever 203 are erected on an upper part of one surface 206 of the switch mounting plate 201. The switch unit 202 having the first lever 203, which is inserted in the rotary shaft 208, is mounted to a switch unit securing portion 209 disposed so as to surround the rotary shaft 208. The main switch 205 is mounted to a main switch securing portion 210 disposed behind the protrusion 207.

As shown in FIG. 17, a rotary shaft 212 for rotatably supporting the second lever 204 is erected in a central part of another surface 211 of the switch mounting plate 201, and a cam 213 formed on the second lever 204 extends through a horizontal hole 214 formed in the central part to protrude above the surface 206.

As shown in FIG. 18, the switch unit securing portion 209 of the switch mounting plate 201 has three anchoring nails 215 protruding above the surface 206 and a rib 217 which is formed to protrude such that it will surround the switch cover 216. The switch unit 202 is integrally mounted to the switch unit securing plate 209 by engaging three tabs 220 formed to protrude from the periphery of the switch cover 216 with anchoring nails 215 with the protrusion 207 inserted through a slot 218 in the first lever 203 and the rotary shaft 208 inserted through a pivot hole 219 of the first lever 203. At this time, the first lever 203 is prevented from coming off the switch mounting plate 201 and is guided in tilting by the same by engaging an arcuate guide hole 221 the lever with a tilt-permitting nail 222 formed to protrude from one surface 206 of the plate. A pressure-receiving protrusion 223 is formed to protrude from the first lever 203. The pressure-receiving lever 223 rotates the first lever 203 with an external force applied thereto form a door key when the door is closed. When the switch cover 216 is attached to the switch mounting plate 201, the switch unit 202 is covered, and the first lever 203 is inserted in the protrusion 207. The support for the first lever 203 is thus provided simply by an operation of mounting the same to the switch mounting plate 201, which simplifies a structure for automatic mounting.

A main switch securing portion 210 of the switch mounting plate 201 has a pair of mounting shafts 224 protruding from the surface 206 and a pair of upper and lower engaging nails 225. The main switch 205 is integrally mounted to the main switch securing portion 210 with the pair of engaging nails 225, with the pair of mounting shafts 224 penetrating through a pair of through holes 226 horizontally extending through the main switch 205 to pivotally support the same. The main switch 205 is disposed tangentially to the second lever 204. Since an operation of returning the second lever 204 can therefore be directly performed using a repulsion that occurs when a push button 227 provided on the main switch 205 returns, there is no need for incorporating a return spring or the like, and the number of components can be thus reduced.

As shown in FIG. 19, a pivot hole 228 of the second lever 204 is rotatably mounted around a rotary shaft 212 on another surface 211 of the switch mounting plate 201. The second lever 204 is formed with a V-shaped outline, and it is formed with a pressure-receiving piece 229 on one end thereof and formed with a cam 213 on another end thereof. Since the pressure-receiving piece 229 rotates the second lever 204 based on an external force received from a door key, the cam 213 turns the push button 227 of the main switch 205 on. The second lever 204 is prevented from coming off the switch mounting plate 201 and is guided in tilting by the same by engaging an arcuate guide hole 230 and an arcuate guide protrusion 231 with tilt-permitting pieces 232 and 233 formed to protrude from the other surface 211.

A base portion 234 of the first lever 203 of the switch unit 202 is rotatably housed in the switch cover 216, and first and second operating portions 235 and 236 are formed to protrude from the periphery of the base portion 234 in the radial direction thereof. A normally open movable contact terminal 251 and a fixed contact terminal 252 which constitute a signal switch 250 serving as a first switch and a first fixed contact terminal 254, a normally closed movable contact terminal 255, and a second fixed contact terminal 256 which constitute a short switch 253 serving as a third switch are mounted in the switch cover 216. The detailed description of the movement of the signal switch 250 and the short switch 253 is omitted because the description of the first embodiment applies. The switch cover 216 may be transparently formed. The state of internal contacts can be thus checked directly.

A protrusion 240 is provided on the second lever 204. When the pressure-receiving piece 229 is urged by an external force from a door key, the protrusion 240 urges the first lever 203 to rotate the same, which allows the main switch 205 to be turned on after the short switch 253 is turned off.

Since the switch unit 202 incorporates the signal switch 250 and the short switch 253, there is no need for providing a micro-switch to be used as a signal switch and a micro-switch to be used as a short switch independently. It is therefore possible to employ a simple structure and to achieve an advantage from the viewpoint of space in that space saving can be achieved. The signal switch 250 operates in conjunction with the operation of a first operation pin, and the switch is operated by the first lever 203 mounted on the switch mounting plate 201 which is located on a side of a heating chamber. The main switch 205 operates in conjunction with the operation of a second operation pin, and the switch is operated by a pin guide mounted on a front panel of the heating chamber and the second lever 204 mounted on the switch mounting plate 201. The signal switch 250 incorporates the short switch 250 which is operated through the first lever 203. Therefore, the signal switch 250 and the short switch 253 can be easily set to operate at different times using the first lever 203. When a door of the heating chamber is closed, the first operating portion 235 of the first lever 203 urges the movable contact portion of the short switch 253 to turn it from off to on, and the second operating portion 236 of the first lever 203 thereafter urges the movable contact portion of the short switch 253 to turn it on. It is therefore possible to allow the heating chamber to operate only after making sure that the door is in the closed state by setting a predetermined time as the interval that passes after the short switch 253 is turned off until the signal switch 250 is turned on.

In the switch unit 202, contact portions of the normally open movable contact terminal 251 and the fixed contact terminal 252 constituting the signal switch 250 and contact portions of the first fixed contact terminal 254, the normally closed movable contact terminal 255, and the second fixed contact terminal 256 constituting the short switch 253 are disposed behind the protrusions 207 and 208. As a result, since a liquid such as meat juice or water which has flowed along the first lever 203 cannot enter the switch unit 202, erroneous operations attributable to corrosion of the contact portions or the like can be avoided. Since the contact portions of the first fixed contact terminal 254, the normally closed movable contact terminal 255, and the second fixed contact terminal 256 constituting the short switch 253 are disposed lower, they are apart from the path of a liquid such as meat juice or water which flows along the first lever 203, and they can be kept less vulnerable to the invasion of a liquid. One of contact portions forming a short circuit between the short switch 253 and the main switch 205 is formed in a substantially R-like shape. As a result, when the contact portions will not scatter when shorted because one of the contact portions is formed in a substantially R-like shape, which makes it possible to form a short circuit reliably. The contact portions of the signal switch 250 and the contact portions of the short switch 253 are offset from each other and wiped when they contact. Each contact portion is thus always cleaned to prevent arcing, whereby a leakage current is prevented. The first lever 203 is returned by an elastic force of a contact piece on the short switch 253. Thus, there is no need for incorporating a returning member such as a return spring in the first lever 203, and it is therefore possible to reduce the number of components.

The first lever 203 is formed with a flange 237 extending forward of the rotary shaft above the base portion 234. A grease reservoir 238 is formed under the base portion 234 so as to protrude in the form of the character L toward the periphery. The flange 237 discharges any liquid such as meat juice or water which has flowed along the first lever 203 to the outside to prevent it from entering the switch unit 202, which makes it possible to prevent any liquid from entering the switch unit 202 and to thereby avoid erroneous operations attributable to corrosion of the contacts and the like. The grease reservoir 238 prevents dust from entering through a gap between the switch mounting plate 201 and the switch cover 216 that is formed to allow the first lever 203 to move and prevents grease applied to the base portion 234 from flowing toward the contacts.

It is preferable to provide an indicator utilizing a difference between the colors of the exteriors of the first lever 203 and the switch unit 202. As a result, it is possible to check the operating position of the switch unit 202 incorporating the signal switch 250 and the short switch 253, in particular, the on and off states of the contacts. An indicator utilizing marks provided on the exteriors of the first lever 203 and the switch unit 202 may alternatively be provided. Thus, the on and off states of the contacts can be checked. A protrusion may be provided on the top side or bottom side of the exterior of the switch unit 202. Thus, connectors to be connected to the signal switch 250 and the short switch 253 in the switch unit will not be erroneously mounted, and the connectors can therefore be reliably mounted.

As shown in FIG. 20, a rib 217 on the switch mounting plate 201 and an edge of the switch cover 216 are formed in a substantially comb-like shape. Since the switch mounting plate 201 and the edge of the switch cover 24 are therefore in the form a maze, it is possible to prevent dust from entering a gap between the switch mounting plate 201 and the switch cover 216.

According to the prior art, when the second lever 204 is forcibly urged, for example, using a thin wire, the short switch 253 is in the on state because the door is open, and a fuse is therefore blown. One possible solution to this is to parallel—connect the normally close short switch 253 downstream of the main switch 205 and a relay contact RL-1 as shown in FIG. 21. In such an arrangement, however, when seizure of the main switch 205 occurs, the first lever 203 is depressed to turn the signal switch 250 on after turning the short switch 253 off, and the relay contact RL-1 is closed to form a power supply circuit. When the cook button is pushed in this state, the magnetron operates although the door is open, and electromagnetic waves thus leak.

On the contrary, according to the invention, the short switch 253 is parallel-connected downstream of the main switch 205 and a fuse F, and a relay contact RL-1 is series-connected downstream of the connection between the short switch 253 and the fuse F. In such a circuit configuration, the fuse F is blown only when the main switch 205 seizes, and the first lever 203 is depressed to turn the short switch 253 off when the relay contact RL-1 seizes. However, since the second lever 204, which is concealed, is not depressed, the main switch 205 remains in the off state, and no electrical circuit is formed. Even if a cooking start button is pushed in this state, the magnetron does not operate, and the leakage of electrical waves can be prevented. As a result, even when the second lever 204 is pushed forcibly with the door kept open, the first lever 203 can be operated in conjunction with the second lever 204 to turn the short switch 253 off.

Operations will now be described with reference to FIGS. 23(*a*)-(*c*), 24(*a*)-(*c*), and 25(*a*)-(*c*).

Normal operations will be first described with reference to FIGS. 23(*a*)-(*c*) and FIGS. 24(*a*)-(*c*).

As shown in FIG. 23(*a*), when a door 500 is open, the first lever 203 and the second lever 204 are in the return position, and the short switch 253, the signal switch 250, and the main switch 205 are on, off, and on, respectively. When the door 500 begins to close, the first lever 203 starts rotating because the pressure-receiving protrusion 223 of the first lever 203 is urged.

As shown in FIG. 23(*b*), since the second lever 204 is not urged even when the door 500 begins to close, only the first lever 203 is rotated, and the normally closed movable contact terminal 255 is urged by the first operating portion 235 is made to leave the first fixed contact terminal 255, which turns the short switch 253 off.

As shown in FIG. 23(*c*), since only the first lever 203 is urged with the second lever 204 kept unurged, the normally closed movable contact terminal 255 is urged by the first operating portion 235 and is electrically connected to the second fixed contact terminal 256 to turn the short switch 253 on. Then, the second operating portion 236 starts urging the normally open movable contact terminal 251.

Figure 24:
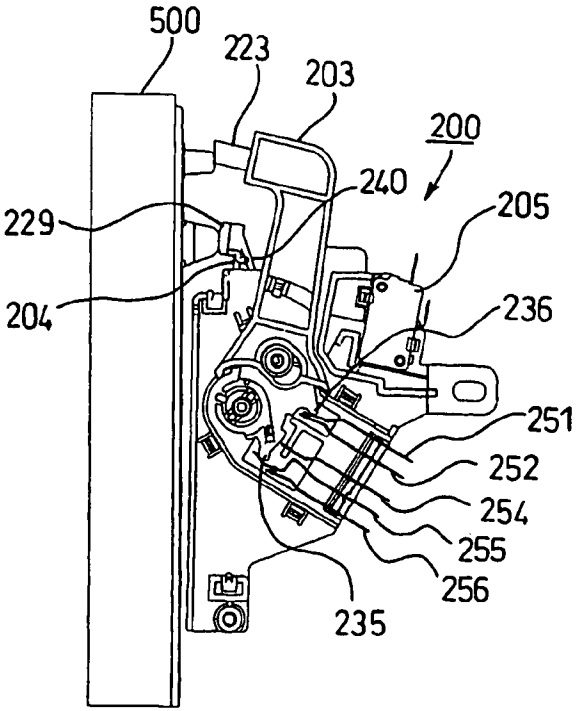
Figure 24:
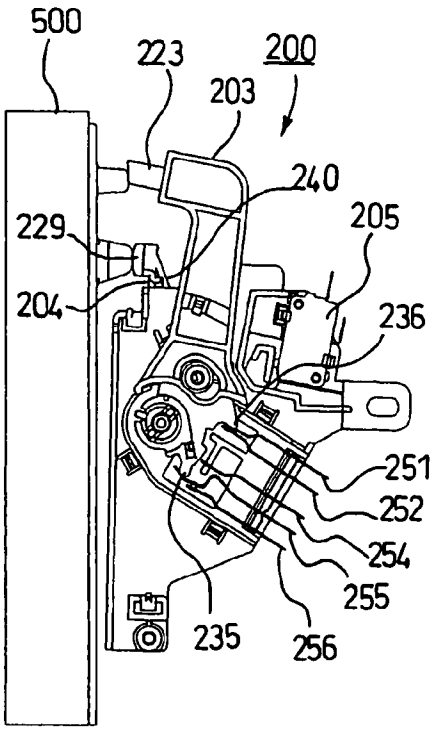
Figure 24:
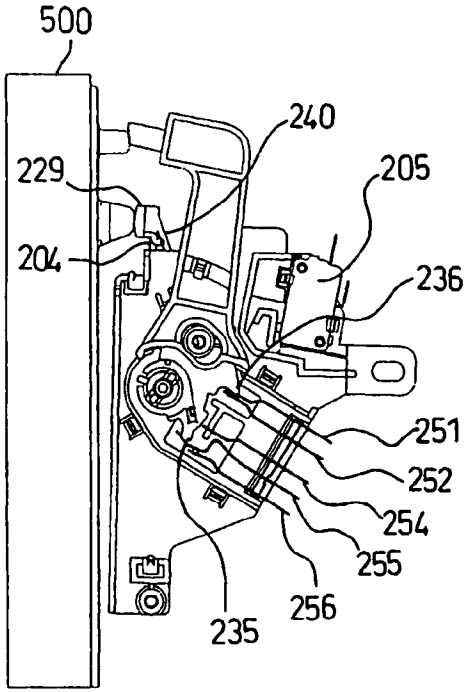

As shown in FIG. 24(*a*), as a result of the rotation of the first lever 203, the normally open movable contact terminal 251 is urged by the second operating portion 236 into electrical contact with the fixed contact terminal 252 to turn the signal switch 250 on. Then, the door 500 starts urging the second lever 204.

As shown in FIG. 24(*b*), as the closure of the door 500 proceeds, the short switch 253 is turned off, and the signal switch 250 is thereafter turned on. Thereafter, the second lever 204 is rotated independently of the first lever 203 to turn the main switch 205 on.

As shown in FIG. 24(*c*), the door 500 is closed when the short switch 253, the signal switch 250, and the main switch 205 are off, on, and on, respectively.

Figure 25:
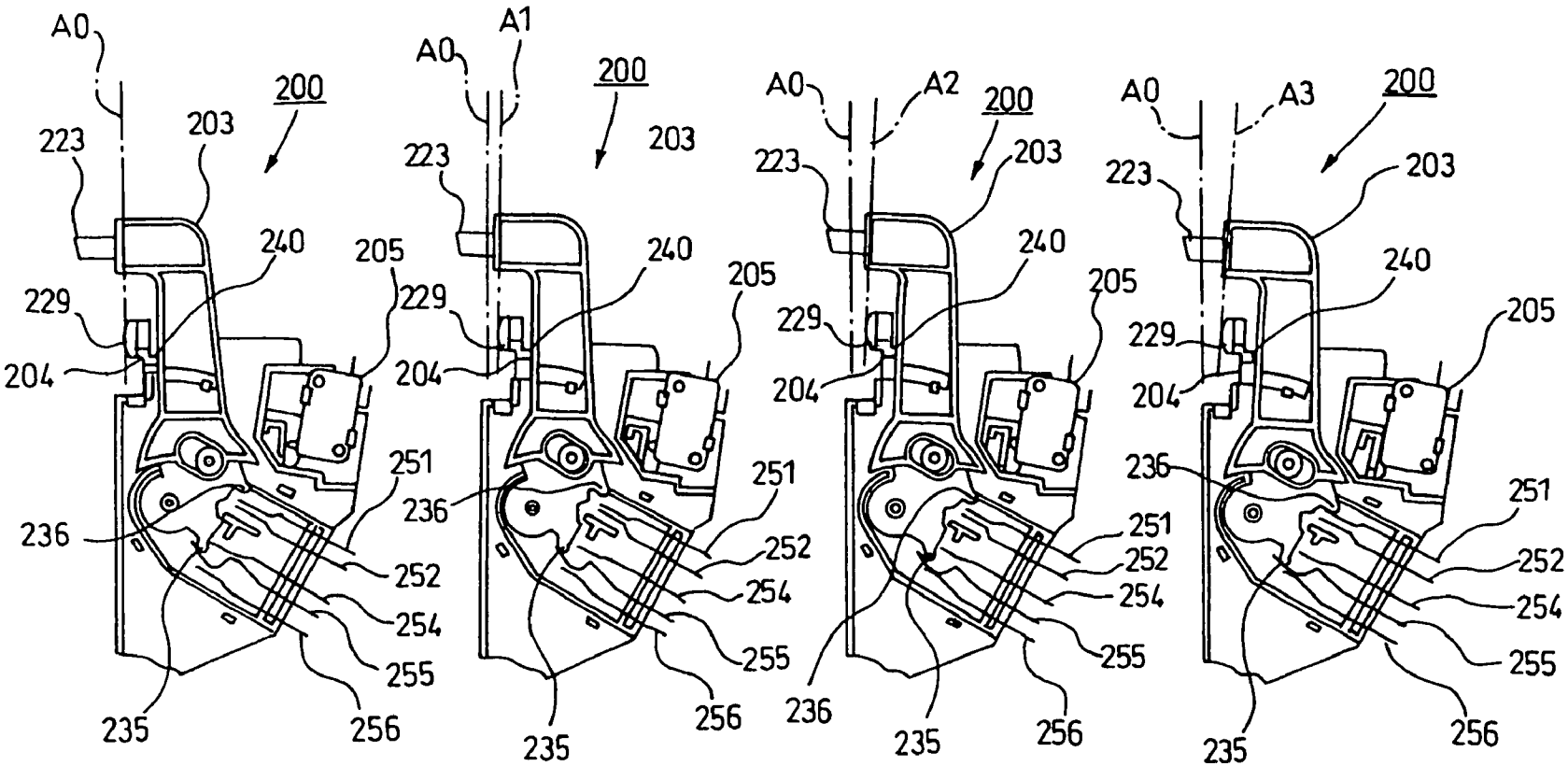

Next, as shown in FIG. 25(*a*), when the door 500 is open, the second lever 204 is in a return position A0, and the short switch 253, the signal switch 250, and the main switch 205 are on, off, and off, respectively.

As shown in FIG. 25(*b*), when the pressure-receiving piece 229 receives an external force to urge and rotate the second lever 204 from the return position A0 to a position A1 forcibly, the protrusion 240 urges and rotates the first lever 203. As a result of the rotation of the first lever 203, the first operating portion 235 urges and moves the normally closed movable contact 255 of the short switch 253, and the short switch 253 is thereby turned off.

As shown in FIG. 25(*c*), when the second lever 204 is further urged to rotate from the position A1 to a position A2, the main switch 205 is turned on.

As shown in FIG. 25(*d*), when the second lever 204 is further urged to rotate from the position A2 to a position A3, the rotation of the second lever 204 stops. At this time, the main switch 205 is on, and the signal switch 250 remains off. Therefore, as the second lever 204 rotates, the first lever 203 is rotated by the protrusion 240 to turn the short switch 253 off and to turn the main switch 205 on thereafter. Thus, even if the second lever 204 is pushed forcibly (pushed intentionally) when the door is open, it is possible to prevent the fuse in the short circuit from being blown.

Referring to correspondence between the configuration of the invention and configurations of the above-described embodiments, the first switch in the first mode for carrying out the invention corresponds to the monitor switch of the embodiment. Similarly, the second switch corresponds to the door switch SW3; the third switch corresponds to the latch switch SW1; the first pivot portion corresponds to the pivot hole 41 and the tilting fulcrum shaft 44; the second pivot portion corresponds to the pivot hole 28 and the fulcrum shaft 29; the first lever pressure-receiving portion corresponds to the pressure-receiving protrusion 23; the second lever pressure-receiving portion corresponds to the pressure-receiving piece 35; and the first to fifth conductive contact pieces correspond to the first to fifth terminals T1 to T5, T11 to T15, and T21 to T25.

The invention may be applied based on the technical ideas disclosed in the claims and is not limited to the configurations of the above-described embodiments.

While the invention has been described in detail with reference to particular embodiments, it will be apparent for those skilled in the art that various changes and modifications may be made without departing from the spirit and scope of the invention.

The present application is based on a Japanese patent application (JP-A-2003-136683) dated May 15, 2003 the contents of which are incorporated herein for reference.

INDUSTRIAL APPLICABILITY

According to the invention, two switches can be incorporated in a single switch case, and a first tilting lever can be provided a common component that allows the contact portions of both switches to be switched in conjunction with the movement of the lever. It is therefore possible to achieve reductions in the number of components, cost, and size of a device. Since both switches can be operated at arbitrary timing in conjunction with the movement of the first tilting lever, the switch can be provided with reliable and stable switching performance, and the switch can therefore be incorporated in a microwave oven as a switch of high safety.

The invention claimed is:

1. A high frequency heating apparatus in which a plurality of switches are switched with time differences by the motion of a plurality of tilting levers that are tilted in accordance with opening and closing operations of a door that exposes and closes an opening on a front side of the microwave oven, the high frequency heating apparatus comprising:

a first switch whose contact portions are switched by elastically displacing a conductive contact piece in a switch case through a first cam formed at an inner end of a first tilting lever when said first tilting lever is tilted;

a second switch whose contact portions are switched by elastically displacing another conductive contact piece in said switch case through a second cam formed at the inner end of said first tilting lever at timing different from the timing for switching the contact portions of said first switch; and a third switch switched through a third cam formed at the inner end of a second tilting lever when said second tilting lever is tilted, wherein a switch unit is formed by integrally incorporating said first tilting lever in said switch case.

2. A high frequency heating apparatus in which a switch base is mounted inside a main body frame associated with a door that exposes and closes an opening on a front side of a microwave oven; a first tilting lever and a second tilting lever tilting at different timing in accordance with opening and closing operations of said door are mounted on the switch base; and three switches mounted on said switch base are switched with time differences by movements of said two tilting levers, in that:

a first pivot portion tiltably pivoted on a switch case and a first cam and a second cam for switching operations are provided at an inner end of said first tilting lever; a first lever pressure-receiving portion associated with a door key mounted on said door is provided at an outer end of said first tilting lever; and the switch case incorporates a first switch which includes a plurality of conductive contact pieces side by side so as to face said first cam and whose contact portions are switched when a first conductive contact piece contacts a second conductive contact piece by being urged and elastically displaced by said first cam as said first tilting lever is tilted and a second switch which includes a plurality of conductive contact pieces provided side by side so as to face said second cam and whose contact portions are switched when said second cam urges a fourth conductive contact piece which has been in contact with a third conductive contact piece to move it away from the same and to thereafter put said fourth conductive contact piece in contact with a fifth conductive contact piece at timing different from the timing for switching the contact portions of said first switch, and in that:

a second pivot portion tiltably pivoted on said switch base and a third cam associated with a push button of a third switch mounted on said switch base to push the same are provided at an inner end of said second tilting lever; and a second lever pressure-receiving portion associated with said door key is provided at an outer end of said second tilting lever.

3. A high frequency heating apparatus according to claim 1 or 2, wherein the distances from the pivot portions where said first tilting lever and second tilting lever are pivoted to the outer ends of the levers are longer than the distances from the pivot portions to the inner ends to set the leverage of the lever outer end of each of said tilting levers that is tilted about pivot portion greater than the leverage of the inner end of the lever.

4. A high frequency heating apparatus according to claim 1 or 2, wherein said switch case is formed by combining a case main body and a case cover and in that a recess having the same shape as that of said case main body is formed on a switch case mounting surface of said switch base.

5. A high frequency heating apparatus according to claim 1 or 2, wherein said switch case is formed by combining a case main body and a case cover and in that a cover portion having the same shape as that of said case cover is formed on a switch case mounting surface of said switch base.

6. A high frequency heating apparatus according to claim 1 or 2, wherein an outer end of each of the conductive contact pieces of said first switch and second switch are aligned with an outer end of a terminal protruding from an outer surface of said third switch so as to protrude in the same direction.

7. A high frequency heating apparatus according to claim 2, wherein a switch unit is formed by integrally incorporating said first tilting lever in said switch case.

* * * * *